US010844709B2

(12) United States Patent
Kusuma et al.

(10) Patent No.: US 10,844,709 B2
(45) Date of Patent: Nov. 24, 2020

(54) METHODS AND SYSTEMS FOR SPECTRUM ESTIMATION FOR MEASURE WHILE DRILLING TELEMETRY IN A WELL SYSTEM

(71) Applicant: Schlumberger Technology Corporation, Sugar Land, TX (US)

(72) Inventors: Julius Kusuma, Fremont, CA (US); Arnaud Jarrot, Somerville, MA (US); Adeel Mukhtar, Katy, TX (US); Liang Sun, Katy, TX (US); Robert W. Tennent, Katy, TX (US); David Kirk Conn, Houston, TX (US); Luis Eduardo DePavia, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 16/544,118

(22) Filed: Aug. 19, 2019

(65) Prior Publication Data

US 2019/0376384 A1 Dec. 12, 2019

Related U.S. Application Data

(62) Division of application No. 16/163,634, filed on Oct. 18, 2018, now Pat. No. 10,422,218, which is a (Continued)

(51) Int. Cl.

| | |
|---|---|
| ***E21B 47/13*** | (2012.01) |
| ***E21B 47/18*** | (2012.01) |
| ***E21B 47/125*** | (2012.01) |

(52) U.S. Cl.
CPC ..... *E21B 47/13* (2020.05); *E21B 47/125* (2020.05); *E21B 47/18* (2013.01)

(58) Field of Classification Search
CPC ..... G01V 11/002
(Continued)

(56) References Cited

U.S. PATENT DOCUMENTS 8,400,326 B2 3/2013 Codazzi
2010/0307828 A1* 12/2010 Hutin ..... E21B 47/18 175/56

(Continued)

OTHER PUBLICATIONS

Stanislav Dokoupil, Jurij Karpinsky, Milan Kaspar, "The attenuation of electromagnetic waves in rocks", Studia Geophysica et Geodaetica, Jun. 1962, vol. 6, Issue 2, pp. 176-192.

*Primary Examiner* — Fabricio R Murillo Garcia

(57) ABSTRACT

A method for configuring transmission signals is disclosed. The method includes receiving a signal from a downhole tool in a wellbore. The signal may include a telemetry portion and a noise portion. The method also includes reproducing the telemetry portion based at least partially on the signal. Further, the method includes subtracting the telemetry portion from the signal. The method includes estimating, based at least partially on the subtraction, the noise portion of the signal. The method also includes altering a transmission configuration of the downhole tool based at least partially on the noise portion of the signal.

6 Claims, 14 Drawing Sheets

Related U.S. Application Data division of application No. 15/623,424, filed on Jun. 15, 2017, now Pat. No. 10,113,418.

(60) Provisional application No. 62/356,990, filed on Jun. 30, 2016.

(58) Field of Classification Search
USPC ..... 340/854.6
See application file for complete search history.

(56) References Cited

U.S. PATENT DOCUMENTS

| | | | | |
|---|---|---|---|---|
| 2010/0314169 | A1* | 12/2010 | Jarrot | E21B 47/13 175/48 |
| 2015/0218937 | A1* | 8/2015 | Conn | E21B 47/01 367/83 |
| 2016/0061027 | A1 | 3/2016 | Gao et al. | |
| 2016/0108724 | A1 | 4/2016 | Jarrot | |
| 2017/0332157 | A1* | 11/2017 | White | H04L 7/041 |
| 2018/0003042 | A1 | 1/2018 | DePavia et al. | |
| 2018/0003043 | A1 | 1/2018 | Gelman et al. | |
| 2018/0003044 | A1 | 1/2018 | Kusuma et al. | |
| 2018/0003527 | A1 | 1/2018 | Jarrot et al. | |
| 2018/0003849 | A1 | 1/2018 | Chung et al. | |
| 2019/0048714 | A1 | 2/2019 | Kusuma et al. | |

* cited by examiner

METHODS AND SYSTEMS FOR SPECTRUM ESTIMATION FOR MEASURE WHILE DRILLING TELEMETRY IN A WELL SYSTEM

CROSS-REFERENCE TO RELATED APPLICATION

This application is a divisional application of U.S. patent application Ser. No. 16/163,634, filed on Oct. 18, 2018, which is a divisional application of U.S. Pat. No. 10,113,418, filed on Jun. 15, 2017, which claims priority to and the benefit of U.S. Provisional Application No. 62/356,990, filed on Jun. 30, 2016, the entirety of all of which are incorporated herein by reference.

BACKGROUND

Electromagnetic ("EM") telemetry may be used to transmit data from a downhole tool in a wellbore to a receiver at the surface. EM telemetry may be bi-directional with half-duplex transmitters and receivers. EM telemetry may implement a time-sharing schedule between uplink and downlink commands. Real-time ("RT") data transmission allows for real-time interpretation and decision-making that may be used for steering, well placement, drilling optimization, and safety. The EM telemetry may be subjected to noise from a variety of sources, e.g., power lines, electrical equipment, other EM systems in the area, etc.

To address the noise, a downlink command may be sent to the transmitters to adjust the uplink modulation parameters. The uplink modulation parameters may be adjusted to maximize a signal-to-noise ratio ("SNR") and minimize power consumed at the transmitters. The uplink modulation parameters may include a modulation type, a carrier frequency, a bandwidth or bitrate, and a signal amplitude for transmission to the surface. When a modulation scheme such as orthogonal frequency-division multiplexing ("OFDM") is used, the uplink modulation parameters may include a number of subcarriers, subcarrier spacing, and/or cyclic prefix length. To improve reliability, Error Correction Coding ("ECC") may be used, and the uplink modulation parameters may include an ECC scheme to be used and its coding rate. To determine the uplink modulation parameters, a spectrum of a received signal may be estimated, and the spectrum may be used to derive a noise estimate. Based on the noise estimate, an uplink frequency and bitrate pairs may be determined that predict a desired SNR. This estimation, however, treats the current uplink telemetry signal as noise, in effect, minimizing any frequency bands which overlap a currently selected frequency band.

SUMMARY

This summary is provided to introduce a selection of concepts that are further described in the detailed description. This summary is not intended to identify key or essential features of the claimed subject matter, nor is it intended to be used as an aid in limiting the scope of the claimed subject matter.

Embodiments of the present application include a method for configuring transmission signals is disclosed. The method includes receiving a signal from a downhole tool in a wellbore. The signal may include a telemetry portion and a noise portion. The method also includes reproducing the telemetry portion based at least partially on the signal. Further, the method includes subtracting the telemetry portion from the signal. The method includes estimating, based at least partially on the subtraction, the noise portion of the signal. The method also includes altering a transmission configuration of the downhole tool based at least partially on the noise portion of the signal.

Embodiments of the present application include a method for configuring transmission signals is disclosed. The method includes receiving a signal from a downhole tool in a wellbore. The signal may include a telemetry portion and a noise portion. The method also includes demodulating the signal to produce a data packet. Further, the method includes generating a modulated signal using the data packet to produce estimated data symbols. The method includes estimating a propagation channel of the signal. The method also includes generating the telemetry portion based at least partially on the estimated data symbols and the estimate of the propagation channel. Additionally, the method includes subtracting the telemetry portion from the signal. The method includes estimating, based at least partially on the subtraction, the noise portion of the signal. The method also includes altering a transmission configuration of the downhole tool based at least partially on the noise portion.

Embodiments of the present application include a method for configuring transmission signals is disclosed. The method includes receiving a signal from a downhole tool in a wellbore. The signal may include a telemetry portion and a noise portion. The method also includes generating an analytical telemetry spectrum. The analytical telemetry spectrum may represent an ideal spectrum of the telemetry portion. The method includes generating a spectrum estimate of the telemetry portion based at least partially on the analytical telemetry spectrum. Further, the method includes subtracting the spectrum estimate of the telemetry portion from a spectrum of the signal. The method also includes estimating, based at least partially on the subtraction, the noise portion of the signal. The method includes altering a transmission configuration of the downhole tool based at least partially on the noise portion.

Embodiments of the present application include a method for configuring transmission signals is disclosed. The method includes receiving a signal from a downhole tool in a wellbore. The signal may include a telemetry portion and a noise portion. The method also includes determining one or more characteristics of the noise portion at one or more receivers of the signal. Further, the method includes estimating a signal strength of the signal. The method includes estimating a signal-to-noise ratio for a modulation setting based at least partially on the one or more characteristics of the noise portion and the signal strength. Additionally, the method includes altering a transmission configuration of the downhole tool based at least partially on the signal-to-noise ratio of the modulation setting.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures.

DETAILED DESCRIPTION

Reference will now be made in detail to specific embodiments illustrated in the accompanying drawings and figures. In the following detailed description, numerous specific details are set forth in order to provide a thorough understanding of the disclosure. However, it will be apparent to one of ordinary skill in the art that the disclosure may be practiced without these specific details. In other instances, well-known methods, procedures, components, circuits, and networks have not been described in detail so as not to unnecessarily obscure aspects of the embodiments.

The terminology used in the disclosure herein is for the purpose of describing particular embodiments only and is not intended to be limiting. As used in the disclosure and the appended claims, the singular forms "a," "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises" and/or "comprising," when used in this specification, specify the presence of stated features, integers, operations, elements, and/or components, but do not preclude the presence or addition of one or more other features, integers, operations, elements, components, and/or groups thereof. Further, as used herein, the term "if" may be construed to mean "when" or "upon" or "in response to determining" or "in response to detecting," depending on the context.

Figure 1:
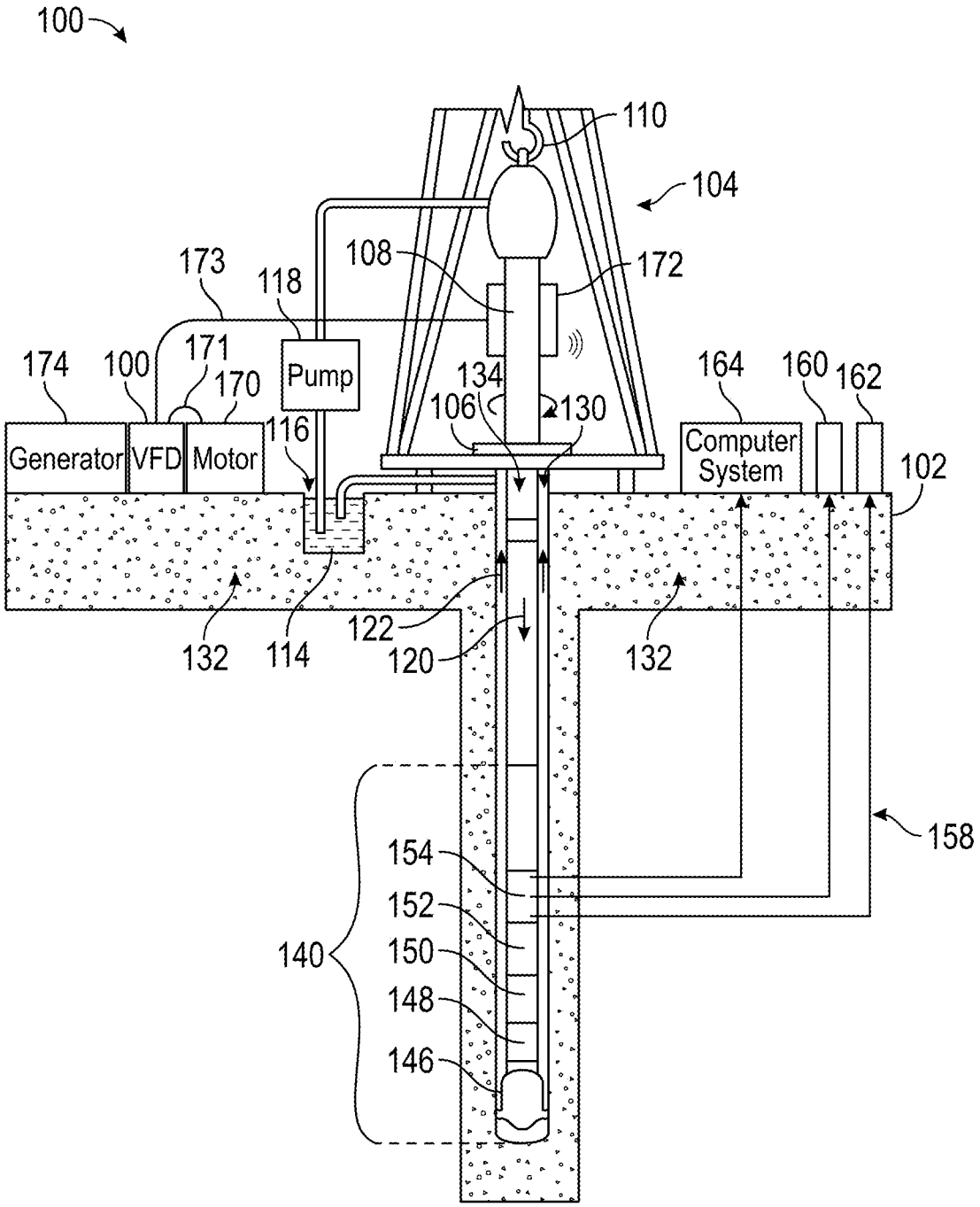
FIG. 1 illustrates a cross-sectional view of an example of a well site system, according to an embodiment.

FIG. 1 illustrates a cross-sectional view of a well site system 100, according to an embodiment. The well site system 100 may include a rig floor supported by a rig sub-structure and derrick assembly 104 positioned over a wellbore 130 that is formed in a subterranean formation 132. The rig sub-structure and derrick assembly 104 may include a rotary table 106, a kelly or top drive 108, and a hook 110. A drill string 134 may be supported by the hook 110 and extend down into the wellbore 130. The drill string 134 may be a hollow, metallic tubular member. The rotation of the drill string 134 may be generated by the top drive 108. However, the rotary table 106 may optionally generate rotary motion that is transmitted through the kelly.

Drilling fluid or mud 114 may be stored in a pit 116 at the well site. A pump 118 may deliver the drilling fluid 114 to the interior of the drill string 134 via a port in the swivel 112, which causes the drilling fluid 114 to flow downwardly through the drill string 134, as indicated by the directional arrow 120. The drilling fluid exits the drill string 134 via ports in a drill bit 146, and then circulates upwardly through the annulus region between the outside of the drill string 134 and a wall of the wellbore 130, as indicated by the directional arrows 122. In this known manner, the drilling fluid lubricates the drill bit 146 and carries formation cuttings up to the surface 102 as it is returned to the pit 116 for recirculation.

A downhole tool (e.g., a bottom-hole assembly) 140 may be coupled to a lower end of the drill string 134. The downhole tool 140 may be or include a rotary steerable system ("RSS") 148, a motor 150, one or more logging-while-drilling ("LWD") tools 152, and one or more measurement-while-drilling ("MWD") tools 154. The LWD tool 152 may be configured to measure one or more formation properties and/or physical properties as the wellbore 130 is being drilled or at any time thereafter. The MWD tool 154 may be configured to measure one or more physical properties as the wellbore 130 is being drilled or at any time thereafter. The formation properties may include resistivity, density, porosity, sonic velocity, gamma rays, and the like. The physical properties may include pressure, temperature, wellbore caliper, wellbore trajectory, a weight-on-bit, torque-on-bit, vibration, shock, stick slip, and the like. The measurements from the LWD tool 152 may be sent to the MWD tool 154. The MWD tool 154 may then group the sets of data from the LWD tool 152 and the MWD tool 154 and prepare the data for transmission to the surface 102 after proper encoding.

The MWD tool 154 may transmit the data (e.g., formation properties, physical properties, etc.) from within the wellbore 130 up to the surface 102 using MWD telemetry, for example, electromagnetic ("EM") telemetry, mud pulse telemetry, and the like. To transmit the digital data stream from within the wellbore 130 to the surface 102, a coding method may be used. For example, a predetermined carrier frequency may be selected and any suitable modulation method, e.g., phase shift keying ("PSK"), frequency shift keying, continuous phase modulation, quadrature amplitude modulation, orthogonal frequency division multiplexing ("OFDM"), may be used to superpose a bit pattern onto a carrier wave. Likewise, for example, a baseband line code, e.g., pulse position modulation, Manchester coding, biphase coding, runlength limited codes (e.g., 4b/5b or 8b/10b coding), may be used to superpose the bit pattern onto a waveform suitable for transmission across the MWD channel. For example, a coded signal may be applied as a voltage differential between upper and lower portions of the downhole tool 140 (e.g., across an insulation layer). Due to the voltage differential between the upper and lower portions of the downhole tool 140, a current 158 may be generated that travels from the lower portion of the downhole tool 140 out into the subterranean formation 132. At least a portion of the current 158 may reach the surface 102.

One or more sensors (two are shown: 160, 162) may be configured to detect telemetry signals from the downhole tool 130. The sensors 160, 162 may be electrodes, magnetometers, capacitive sensors, current sensors, hall probes, gap electrodes, toroidal sensors, etc. The sensors 160, 162 may be positioned in and/or configured to detect signals from a single wellbore 130 or multiple wellbores. The sensors 160, 162 may operate on land or in marine environments. The sensors 160, 162 may communicate unidirectionally or bi-directionally. The sensors 160, 162 may use automation, downlinking, noise cancellation, etc., and may operate with acquisition software and/or human operators.

In an example, the sensors 160, 162 may be metal stakes positioned at the surface 102 that are configured to detect part of the current 158 travelling through the subterranean formation 132 and/or a voltage differential between the sensors 160, 162. In other embodiments, one or more of the sensors 160, 162 may be positioned within the wellbore 130 (e.g., in contact with a casing), within a different wellbore, coupled to a blow-out preventer (not shown), or the like. The current and/or voltage differential may be measured at the sensors 160, 162 by an ADC connected to the sensors 160, 162. The output of the ADC may be transmitted to a computer system 164 at the surface 102. By processing of the ADC output, the computer system 164 may then decode the voltage differential to recover the data transmitted by the MWD tool 154 (e.g., the formation properties, physical properties, etc.).

Real-time ("RT") LWD and MWD data may enable real-time evaluation of the subterranean formation 132. The data may also be used for decision-making in steering, well placement, drilling optimization, and safety. The system and method disclosed herein use the bi-directional communication link offered by MWD telemetry, e.g., EM MWD telemetry, mud pulse telemetry, etc., to enable new applications and improve the overall quality of the received data at the surface 102.

One issue with wireless communication is that noise may be introduced into the MWD telemetry. According to embodiments, an estimate of available frequency bands may be achieved by removing uplink telemetry signals prior to the spectrum estimations. By removing the uplink telemetry signals, spectrum estimates may be obtained where the uplink and downlink signals are present and within frequency ranges of the uplink and downlink signal.

In an embodiment, an energy or power from a particular frequency, time, or both may be estimated based on the received signal. The received signal can be represented as the sum of the telemetry signal (or telemetry portion) and the noise signal (or noise portion). By obtaining an estimate of the telemetry signal energy, the estimate of the telemetry signal energy may be subtracted from the received signal energy to obtain a noise estimate.

The received signal may be given by the equation:

$$y(t)=x(t)+n(t) \tag{1}$$

where y(t) is the received signal, x(t) is the telemetry signal, and n(t) is the noise. The telemetry signal may represent a noiseless telemetry signal as seen by the receiver (e.g., sensors 160,162). For example, the telemetry signal, x(t), may include an effect of a propagation channel, which may be modeled as a convolution between a telemetry modulation signal, s(t), and the impulse response of a propagation channel, w(t). This may be represented by the equations:

$$x(t)=s(t)*w(t) \tag{2}$$

or equivalently, $$X(t)=S(t)*W(t) \tag{3}$$

where * is the convolution in the time domain.

For example, a common modulation may be a linear modulation given by the equations:

$$s(t)=\Re\{\Sigma_k a_k \cdot p(t-k\cdot T)\cdot \exp(i\cdot 2\cdot \pi\cdot f_c\cdot t)\} \tag{4}$$

$$s(t)=\Re\{\Sigma_k a_k \cdot p(t-k\cdot T-t)\cdot \exp(i\cdot 2\cdot \pi\cdot (f_c+\Delta f)\cdot (t-\tau)+\phi)\} \tag{5}$$

where t is time, $a_k$ are modulation symbols, s(t) is the pulse shape, T is the symbol period, $f_c$ is the carrier frequency, $\phi$ is the phase offset, $\tau$ is the time delay.

In the frequency domain, the received signal, Y(f), may be given by the equation:

$$Y(f)=X(f)+N(f) \tag{6}$$

where X(f) is the telemetry signal in the frequency domain, and N(f) is the noise in the frequency domain. Further, Pyy(f), Pxx(f), and Pnn(f) may correspond to spectrum estimates of the received signal, the telemetry signal and the noise, respectively. These can be given by the equations:

$$P_{yy}(f)=E[|Y(f)|^2] \tag{7}$$

$$P_{xx}(f)=E[|X(f)|^2] \tag{8}$$

$$P_{nn}(f)=E[|N(f)|^2] \tag{9}$$

When considering short-time estimates, Syy(f,t) may be used where f and t correspond to discretized frequency and time, respectively. Any method or processes in signal processing may be used to estimate Pyy(f) and Syy(f,t), from measurements.

Figure 2:
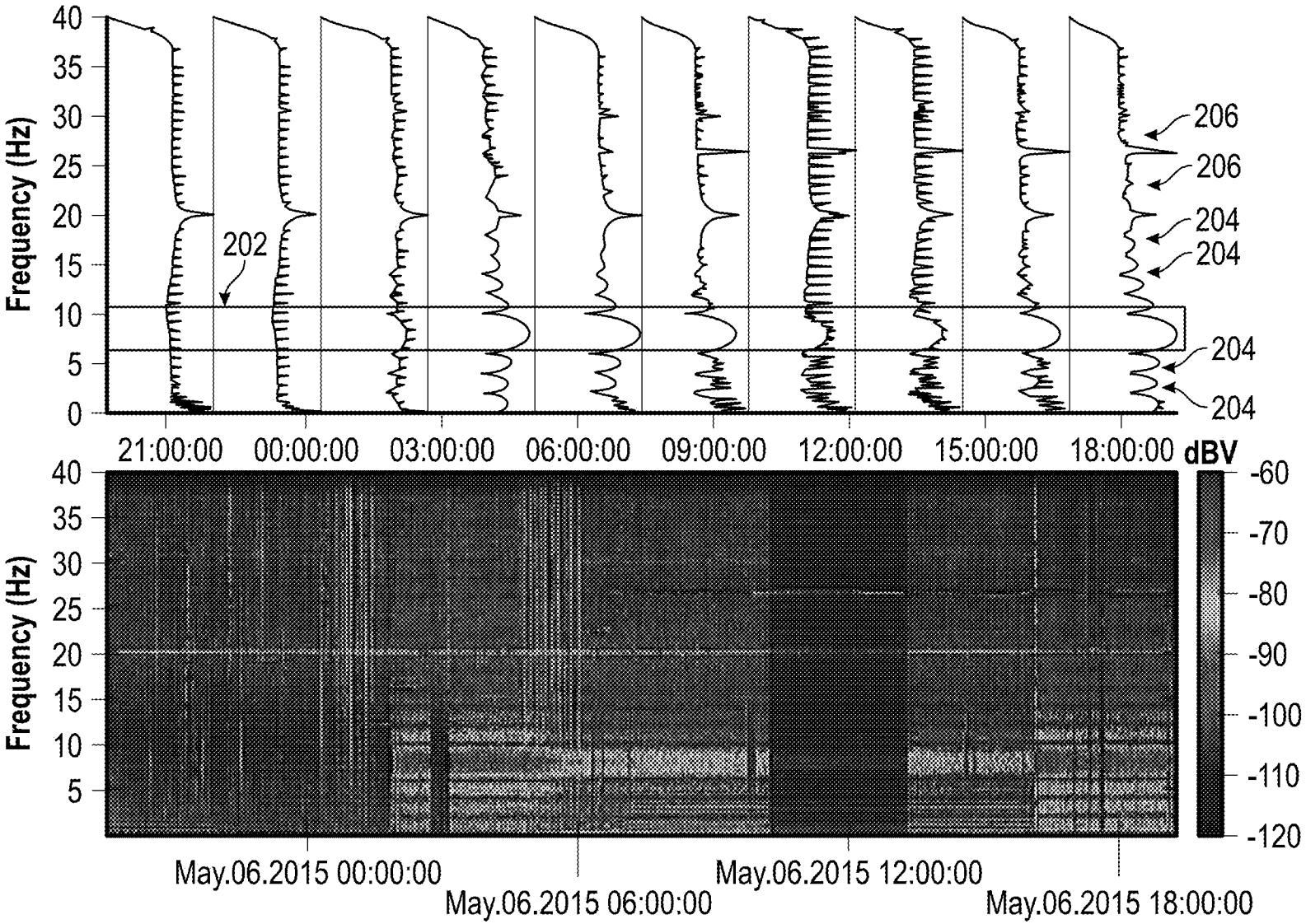
FIG. 2 illustrates a diagram of an example of a received signal including a telemetry portion and noise portion, according to an embodiment.

FIG. 2 illustrates an example of a sequence of spectrum estimates (top) and a corresponding spectrogram (bottom). In this example, the uplink telemetry signal may be at 8 hertz (Hz)/4 bits per second (bps) Quadrature Phase Shift Keying ("QPSK"). As shown, the uplink telemetry signal has a main lobe 202 of approximately 4 Hz wide and side lobes 204 that contain energy. In order to derive a noise estimate for the uplink telemetry signal, the uplink telemetry signal may be compensated for in the noise estimates. If not compensated, the noise estimate based on the received signal may be derived during silent periods or outside frequency bands that contain energy greater than a predetermined level from the uplink telemetry signal. For example, without compensating for the uplink telemetry signal, noise may be estimated across the spectra at the beginning when there was no telemetry or above 22 Hz. Additionally, for example, without compensating for the uplink telemetry signal, a noise harmonic 206 may be examined at 20 Hz, and the spectrum estimate at the beginning of the example may be compared to the uplink telemetry signal. As such, the energy from the telemetry signal compacts the estimate of noise power, even though the telemetry signal is centered around 8 Hz and the noise harmonic is at 22 Hz.

In an embodiment, the telemetry signal may be compensated for using a power-based compensation. In the power-based compensation, Pxx(f) may be estimated and subtracted from an estimate of Pyy(f) to obtain an estimate of Pnn(f). In an embodiment, the telemetry signal, from a spectrogram, may be compensated for using an energy-based compensation (indirect method). In the indirect method, Sxx(f,t) may be estimated and subtracted from an estimate of Syy(f,t) to obtain an estimate of Pnn(f,t). In an embodiment, the telemetry signal may be compensated for using a direct method. In the direct method, x(t) may be estimated directly and subtracted from y(t) to obtain n(t). Once n(t) is obtained, Pnn(f) and Snn(f,t) can be calculated.

In an embodiment, the telemetry signal may be affected by the propagation channel, source characteristics, and sensor characteristics. In an embodiment, these effects may be considered together and referred to as the propagation channel.

Once the telemetry signal is compensated and the noise is obtained, one or more processes may be determined and implemented to address the noise. A telemetry mode and parameters may be determined and implemented based on the spectrum estimates and noise. The telemetry mode and parameters may include one or more of a modulation type for transmitting the signal, a frequency band for transmitting the signal, a bit rate for transmitting the signal, a modulation rate for transmitting the signal, a carrier rate for transmitting the signal, a symbol rate for transmitting the signal, an amplitude for transmitting the signal, a pulse shape for transmitting the signal, a cyclic prefix length for transmitting the signal, a number of subcarriers for transmitting the signal, active subcarriers for transmitting the signal, a bandwidth for transmitting the signal, and the like. For example, the telemetry mode and parameters may include an optimal frequency bitrate pair, SNR/Watt ratio, highest bitrate, and/or highest SNR. In a dual telemetry situation, the telemetry mode and parameters may include an optimal transmission method, e.g., mud pulse or EM, and an optimal frequency and bitrate. In an EM multi-pad system, the telemetry mode and parameters may include frequency and bitrate options that maximize total throughput for the tools. Any of these may allow the downhole tool 140 to transmit with lower amplitude, which may save power.

The spectrum estimates may be used to determine a type of noise in the received signals. The type of noise may be used to determine, suggest, and implement one or more noise compensation methods. For example, the one or more noise compensation methods may include bit interleaving and error correction code ("ECC") implemented in the transmitter, optimal block size to minimize latency, selecting an optimal carrier frequency and modulation type and bit rate, selecting subcarriers and assigning bit loading to those carriers in an OFDM signal, or frequency hopping for varying or unpredictable noise.

An estimation of the effectiveness of the telemetry mode and parameters may be provided. For example, the estimation may include a depth at which the telemetry mode and parameters would become undesirable, e.g., low SNR. The signal attenuation with depth may be based on an EM propagation model specific to a formation being drilled, a general model which assumes a homogenous formation, and the like.

Figure 3:
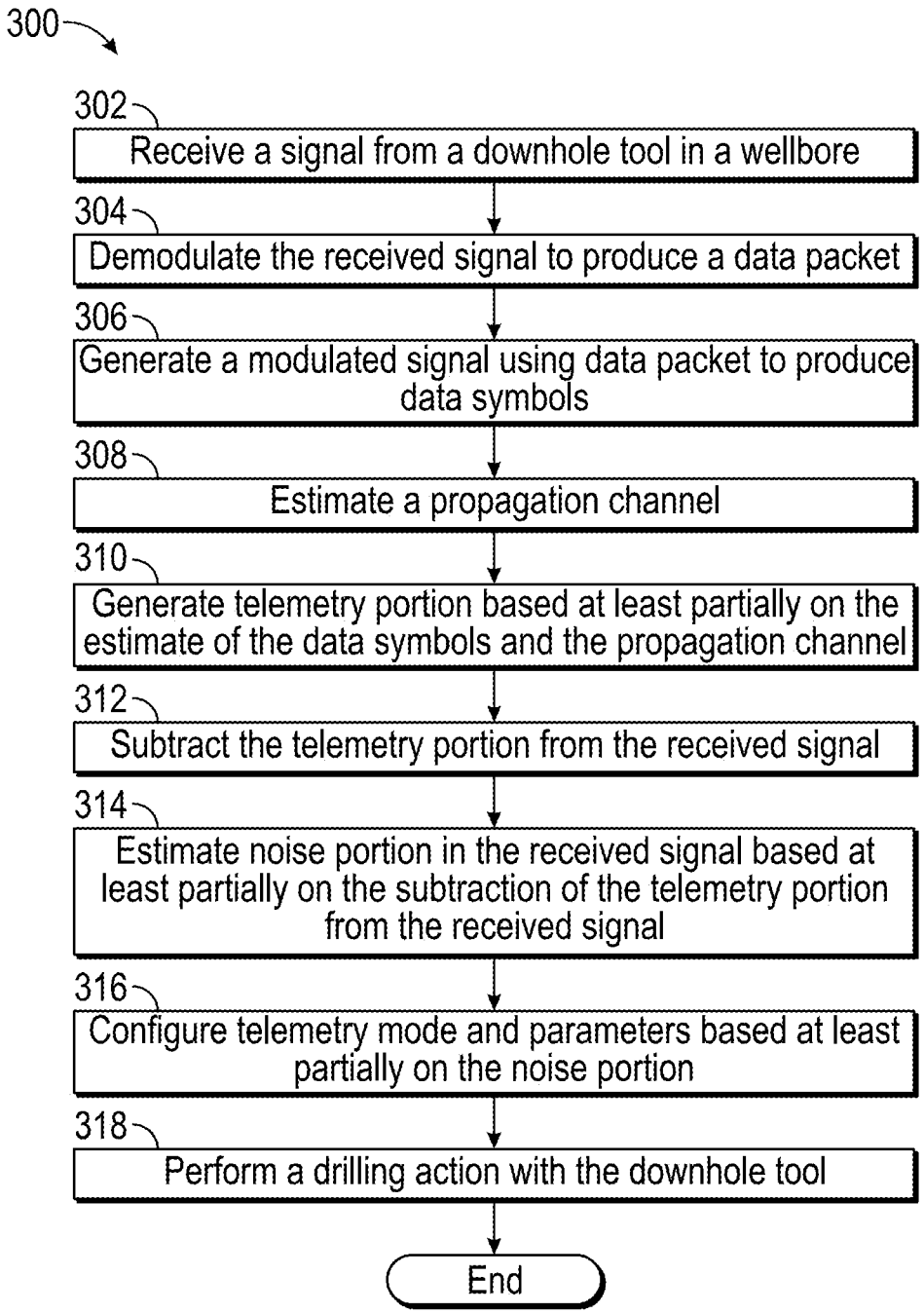
FIG. 3 illustrates a flowchart of an example of a method for estimating noise and configuring signal transmission, according to an embodiment.

FIG. 3 illustrates an example of a direct method 300 for estimating a spectrum of a telemetry signal and configuring transmission signals, according to an embodiment. After the process begins, in 302, a signal may be received from one or more downhole tools in a wellbore. The received signal may include a telemetry portion and a noise portion. The received signal may be any type of signal, for example, an EM signal, a mud pulse signal, etc. The received signal may be transmitted from any type of tool within the wellbore. For example, the received signal may be transmitted by one or more MWD tools 154, one or more LWD tools 152, etc. The signal may be received by any type of receiver (e.g., sensors 160, 162). For example, the signal may be received by one or more EM sensors, one or more deep electrodes, etc. The signal may be detected by measuring a raw voltage across two electrodes.

In 304, the received signal may be demodulated to produce a data packet. In an embodiment, the data packet may include binary data representing the received signal, e.g., 0's and 1's. For example, the received signal may be compared to one or more thresholds to convert the received signal into binary data. For instance, if the signal at a certain time exceeds a threshold, the signal at that time, may be determined to be a "1," otherwise may be determined to be a "0."

In 306, a modulated signal may be generated using the data packet to produce data symbols. The modulated signal may be generated using phase modulation, for example, PSK (e.g., QPSK). Phase modulation is a digital modulation scheme that conveys data by changing (e.g., modulating) the phase of a reference signal (e.g., the carrier wave). Phase modulation may convey data by changing some aspect of a base signal, the carrier wave (e.g., a sinusoid), in response to a data signal. In the case of PSK, the phase may be changed to represent the data signal. There may be two ways of utilizing the phase of a signal in this way: (1) by viewing the phase itself as conveying the information, in which case the demodulator may have a reference signal to compare the received signal's phase against; or (2) by viewing the change in the phase as conveying information—differential schemes, some of which may not use a reference carrier (to a certain extent). For example, QPSK may use four phases, although any number of phases may be used. QPSK may use four points on the constellation diagram, equi-spaced around a circle. With four phases, QPSK may encode two bits per symbol to minimize the bit error rate ("BER").

In 308, a propagation channel may be estimated. In embodiments, the propagation channel may be a channel through which the received signal is transmitted from the one or more downhole tools to the one or more sensors. For example, the impulse response of a propagation channel, w(t), can be utilized to estimate the propagation channel. In an embodiment, the propagation channel may include an attenuation due to formation resistivity. For example, a model of the formation that describes the attenuation due to resistivity may be utilized. The model may be a specific model for the formation being drilling or may be a general model based on similar formations.

In 310, the telemetry portion may be generated based at least partially on the estimate of the data symbols and the propagation channel. For example, the telemetry portion may be generated directly utilizing the data symbols or packets determined for the received signal and the telemetry and mode parameters used to send the received signal, e.g., modulation type, carrier signal, pulse shaping, etc. Additionally, for example, the attenuation of the received signal may be determined utilizing propagation channel that has been estimated. For instance, any of the equations (1) through (9) may be utilized in the generation and determination.

Once generated, in 312, the telemetry portion may be subtracted from the received signal. In 314, the noise portion in the received signal may be estimated based at least partially on the subtraction of the telemetry portion form the received signal.

In 316, the telemetry mode and parameters may be configured based at least partially on the noise. In an embodiment, a telemetry mode and parameters may be determined and implemented based on the spectrum estimates and noise. The telemetry mode and parameters may include one or more of a modulation type for transmitting the signal, a frequency band for transmitting the signal, a bit rate for transmitting the signal, a modulation rate for transmitting the signal, a carrier rate for transmitting the signal, a symbol rate for transmitting the signal, an amplitude for transmitting the signal, a pulse shape for transmitting the signal, a cyclic prefix length for transmitting the signal, a number of subcarriers for transmitting the signal, active subcarriers for transmitting the signal, a bandwidth for transmitting the signal, and the like. For example, the telemetry mode and parameters may include an optimal frequency bitrate pair, SNR/Watt ratio, highest bitrate, and/or highest SNR. In a dual telemetry situation, the telemetry mode and parameters may include an optimal transmission method, e.g., mud pulse or EM, and an optimal frequency and bitrate. In an EM multi-pad system, the telemetry mode and parameters may include frequency and bitrate options that maximize total throughput for the tools. Any of these may allow the downhole tool 140 to transmit with lower amplitude, which may save power.

The spectrum estimates may be used to determine a type of noise in the received signals. The type of noise may be used to determine, suggest, and implement one or more noise compensation methods. For example, the one or more noise compensation methods may include bit interleaving and ECC implemented in the transmitter, optimal block size to minimize latency, selecting an optimal carrier frequency and modulation type and bit rate, selecting subcarriers and assigning bit loading to those carriers in an OFDM signal, or frequency hopping for varying or unpredictable noise.

An estimation of the effectiveness of the telemetry mode and parameters may be provided. For example, the estimation may include a depth at which the telemetry mode and parameters would become undesirable, e.g., low SNR. The signal attenuation with depth may be based on an EM propagation model specific to a formation being drilled, a general model which assumes a homogenous formation, and the like. Once determined, the telemetry mode and parameters may be transmitted to the one or more downhole tools, for example, via the downlink telemetry signal.

In 318, in response to configuring the telemetry mode and/or parameters, a signal may be transmitted to the downhole tool 140 to cause the downhole tool 140 to perform a drilling action. The drilling action may include varying a trajectory of the downhole tool 140 (e.g., to steer the downhole tool 140 into a pay zone layer). In another embodiment, the drilling action may include varying a weight-on-bit ("WOB") of the downhole tool 140 at one or more locations in the subterranean formation 132. In another embodiment, the drilling action may include varying a flow rate of fluid being pumped into the wellbore 130. In another embodiment, the drilling action may include varying a type (e.g., composition) of the fluid being pumped into the wellbore 130 in response to the property. In another embodiment, the drilling action may include measuring one or more additional properties in the subterranean formation 132 using the downhole tool 140.

Figure 4:
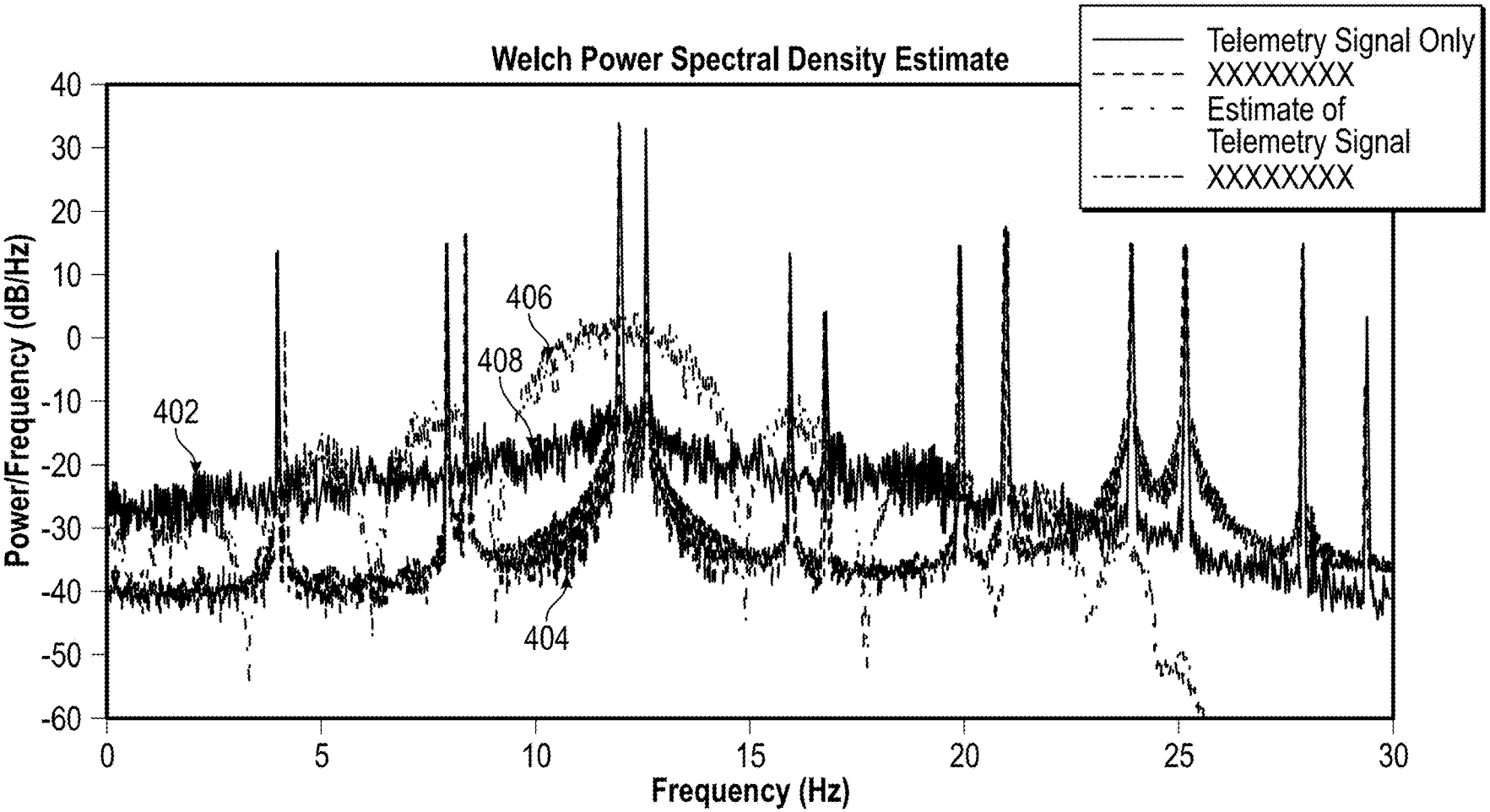
FIG. 4 illustrates a diagram of an estimation of noise in a signal based on the method of FIG. 3, according to an embodiment.

FIG. 4 illustrates the estimation of the spectrum and noise based on the method 300. As illustrated, the plot 402 represents the spectrum of the true telemetry signal after being generated from the received signal. The plot 404 represents the true noise. The plot 406 represents the estimate of the telemetry signal after being generated from the received signal. The plot 408 represents the noise after subtracting the estimate of the telemetry signal.

Figure 5:
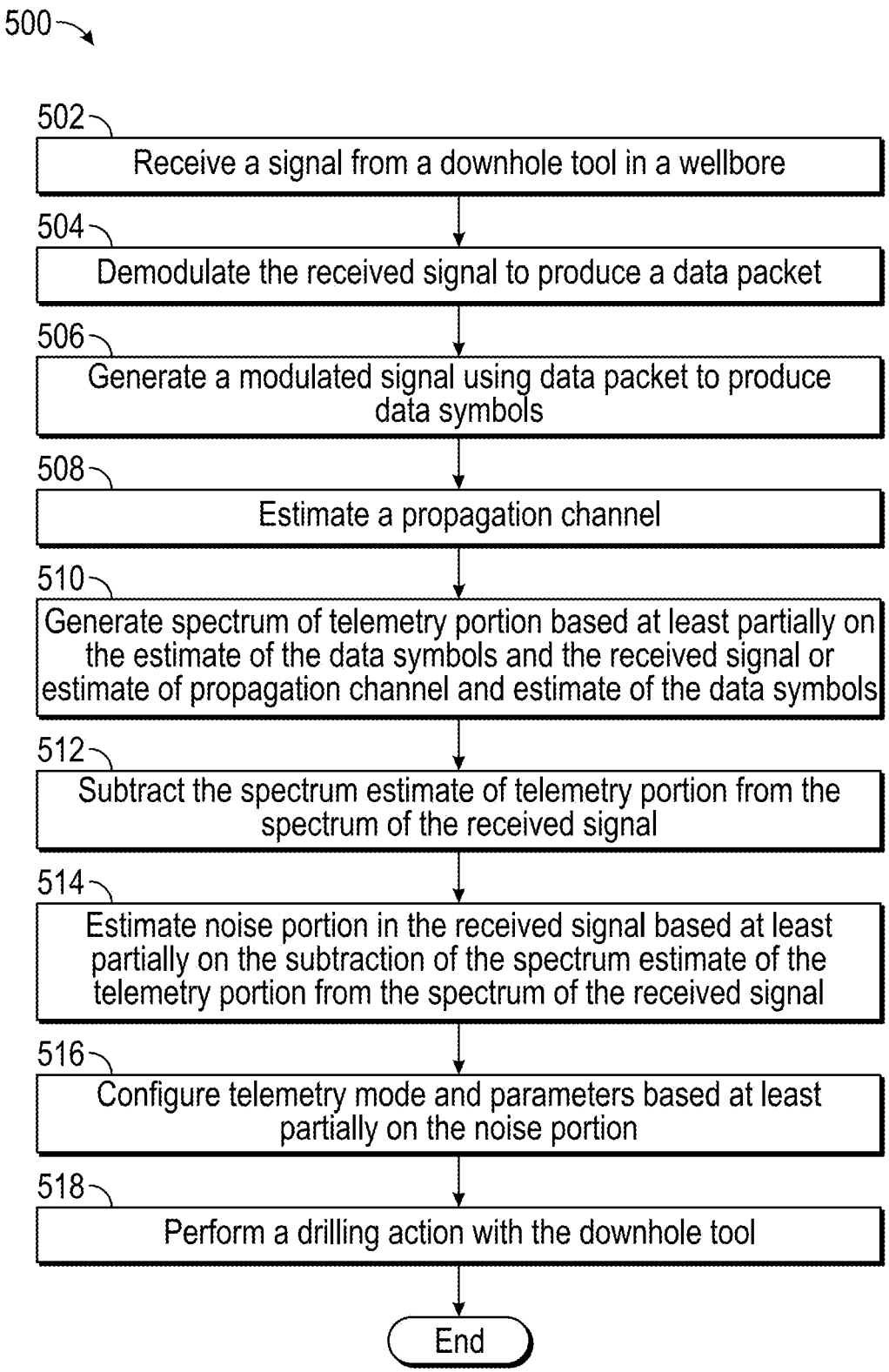
FIG. 5 illustrates a flowchart of an example of an indirect method for estimating a spectrum of a telemetry signal and configuring transmission signals, according to an embodiment.

FIG. 5 illustrates an example of an indirect method 500 for estimating a spectrum of a telemetry signal and configuring transmission signals, according to an embodiment. After the process begins, in 502, a signal may be received from one or more downhole tools in a wellbore. The received signal may include a telemetry portion and a noise portion. The received signal may be any type of signal, for example, an EM signal, a mud pulse signal, etc. The received signal may be transmitted from any type of tool within the wellbore. For example, the received signal may be transmitted by one or more MWD tools 154, one or more LWD tools 152, etc. The signal may be received by any type of receiver (e.g., sensors 160, 162). For example, the signal may be received by one or more EM sensors, one or more deep electrodes, etc. The signal may be detected by measuring a raw voltage across two electrodes.

In 504, the received signal may be demodulated to produce a data packet. The data packet may include binary data representing the received signal, e.g., 0's and 1's. For example, the received signal may be compared to one or more thresholds to convert the received signal into binary data. For instance, if the signal at a certain time exceeds a threshold, the signal at that time, may be determined to be a "1," otherwise may be determined to be a "0."

In 506, a modulated signal may be generated using the data packet to produce data symbols. The modulated signal may be generated using phase modulation, for example, PSK (e.g., QPSK).

In 508, a propagation channel may be estimated. The propagation channel may be a channel through which the received signal is transmitted from the one or more downhole tools to the one or more sensors. For example, the impulse response of a propagation channel, w(t), can be utilized to estimate the propagation channel. The propagation channel may include an attenuation due to formation resistivity. For example, a model of the formation that describes the attenuation due to resistivity may be utilized. The model may be a specific model for the formation being drilling or may be a general model based on similar formations.

In 510, a spectrum of the telemetry portion may be generated based at least partially on the estimate of the data symbols and the received signal, or an estimate of propagation channel and an estimate of the data symbols. For example, the spectrum of the telemetry portion may be simulated utilizing the data symbols or packets determined for the received signal and the telemetry and mode parameters used to send the received signal, e.g., modulation type, carrier signal, pulse shaping, etc. Additionally, for example, the attenuation of the received signal may be simulated utilizing propagation channel that has been estimated. For instance, any of the equations (1) through (9) may be utilized in the simulations.

Once generated, in 512, the spectrum estimate of the telemetry portion may be subtracted from the spectrum of the received signal. In 514, the noise portion in the received signal may be estimated based at least partially on the subtraction of the spectrum estimate of the telemetry signal from the spectrum of the received signal.

In 516, the telemetry mode and parameters may be configured based at least partially on the noise portion. A telemetry mode and parameters may be determined and implemented based on the spectrum estimates and noise. The telemetry mode and parameters may include one or more of a modulation type for transmitting the signal, a frequency band for transmitting the signal, a bit rate for transmitting the signal, a modulation rate for transmitting the signal, a carrier rate for transmitting the signal, a symbol rate for transmitting the signal, an amplitude for transmitting the signal, a pulse shape for transmitting the signal, a cyclic prefix length for transmitting the signal, a number of subcarriers for transmitting the signal, active subcarriers for transmitting the signal, a bandwidth for transmitting the signal, and the like. For example, the telemetry mode and parameters may include an optimal frequency bitrate pair, SNR/Watt ratio, highest bitrate, and/or highest SNR. In a dual telemetry situation, the telemetry mode and parameters may include an optimal transmission method, e.g., mud pulse or EM, and an optimal frequency and bitrate. In an EM multi-pad system, the telemetry mode and parameters may include frequency and bitrate options that maximize total throughput for the tools. Any of these may allow the downhole tool 140 to transmit with lower amplitude, which may save power.

The spectrum estimates may be used to determine a type of noise in the received signals. The type of noise may be used to determine, suggest, and implement one or more noise compensation methods. For example, the one or more noise compensation methods may include bit interleaving and ECC implemented in the transmitter, optimal block size to minimize latency, selecting an optimal carrier frequency and modulation type and bit rate, selecting subcarriers and assigning bit loading to those carriers in an OFDM signal, or frequency hopping for varying or unpredictable noise.

An estimation of the effectiveness of the telemetry mode and parameters may be provided. For example, the estimation may include a depth at which the telemetry mode and parameters would become undesirable, e.g., low SNR. The signal attenuation with depth may be based on an EM propagation model specific to a formation being drilled, a general model which assumes a homogenous formation, and the like. Once determined, the telemetry mode and parameters may be transmitted to the one or more downhole tools, for example, via the downlink telemetry signal.

In 518, in response to configuring the telemetry mode and/or parameters, a signal may be transmitted to the downhole tool 140 to cause the downhole tool 140 to perform a drilling action. The drilling actions are described above.

Figure 6:
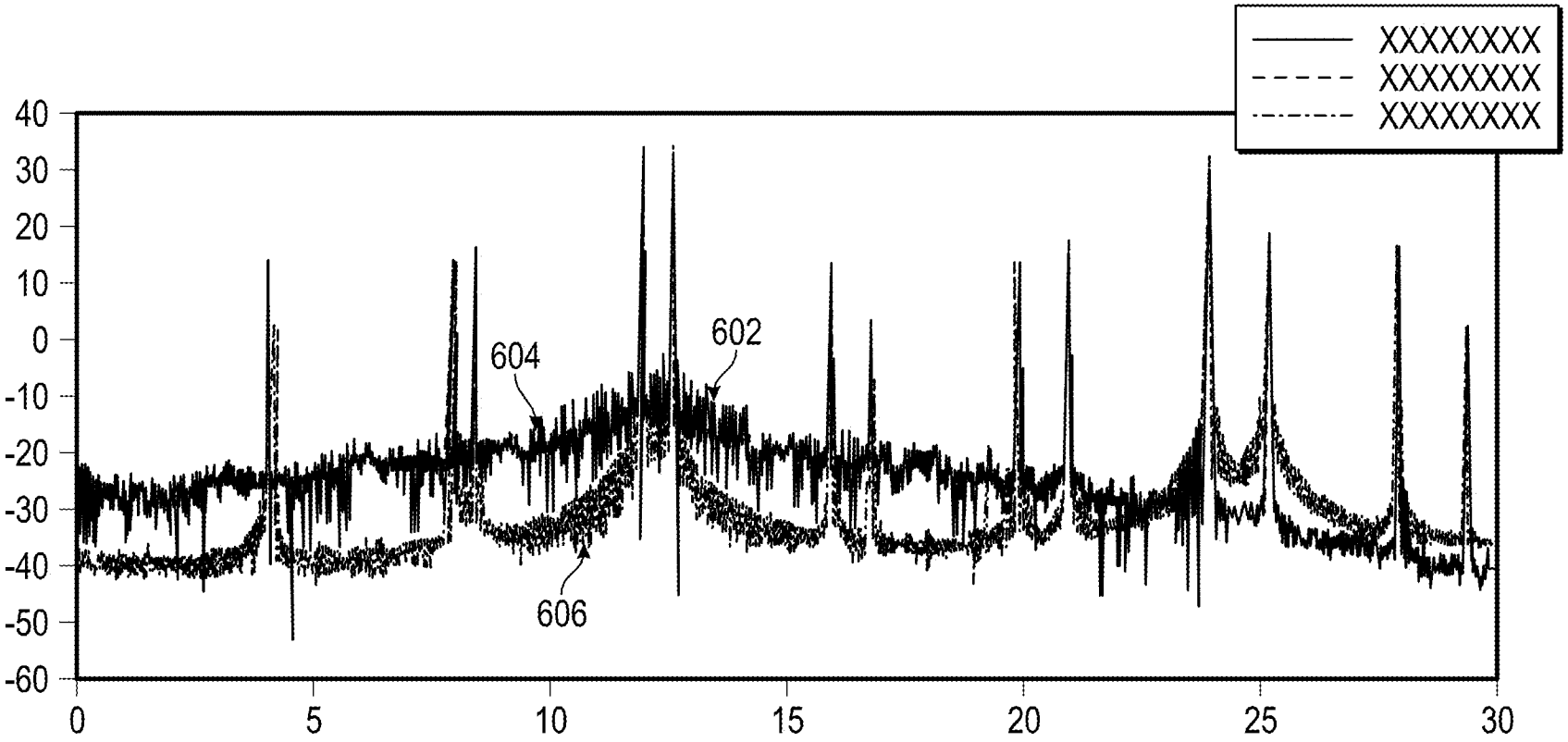
FIG. 6 illustrates a diagram of a comparison of the method of FIG. 3 and the method of FIG. 5, according to an embodiment.

FIG. 6 illustrates a comparison of results of the method 300 and the method 500. As illustrated, the plot 602 represents the indirect method 500. The red 604 represents the direct method 300. The yellow 606 represents the noise. As shown, both methods may be able to suppress an effect of the telemetry signal by about 10-20 decibels (dB).

Figure 7:
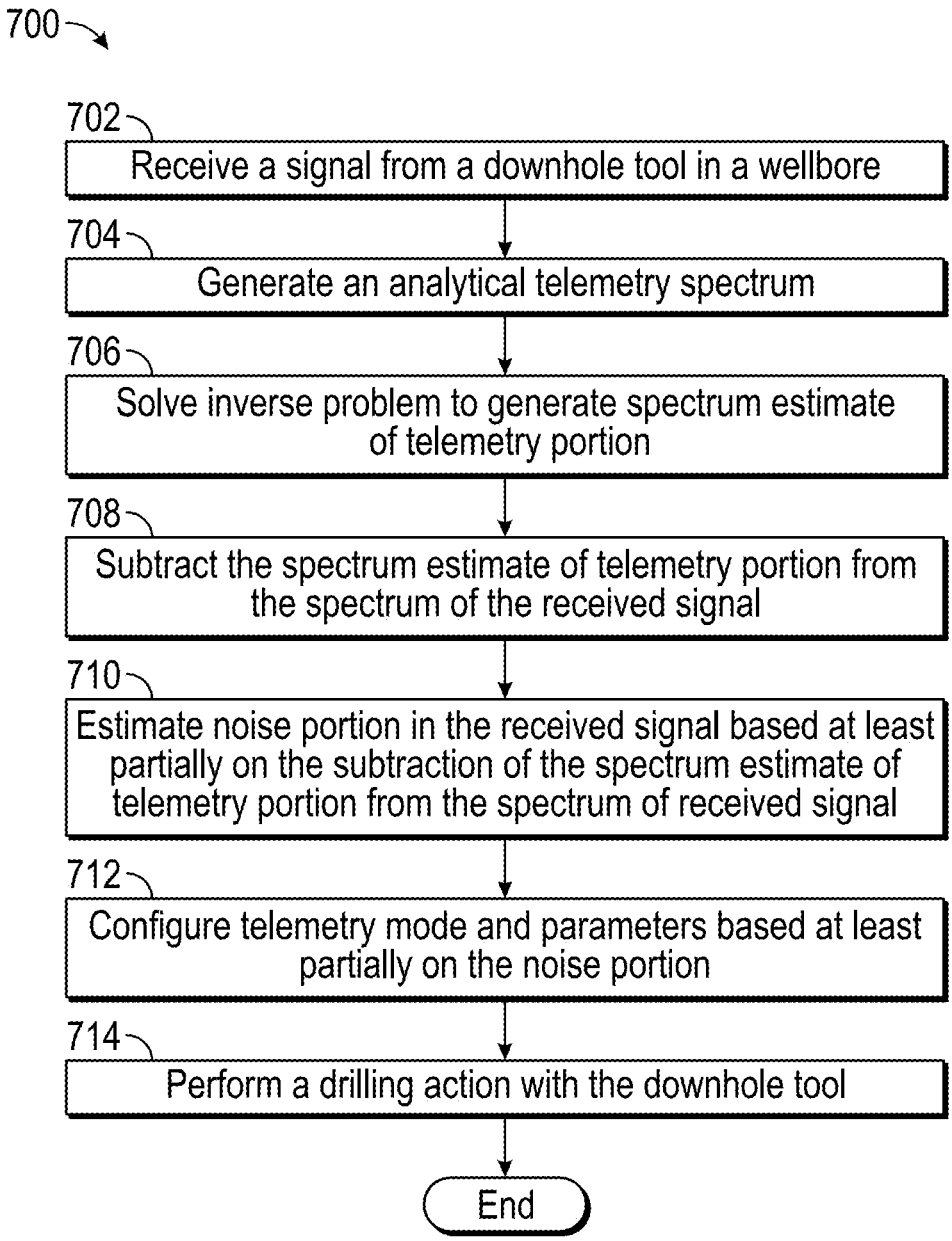
FIG. 7 illustrates a flowchart of an example of a method for estimating a spectrum of a telemetry signal using an analytical telemetry spectrum and configuring transmission signals, according to an embodiment.

FIG. 7 illustrates an example of a method 700 using an analytical telemetry spectrum for estimating a spectrum of a telemetry signal and configuring transmission signals, according to an embodiment. For example, in a case of low SNR, demodulation of the telemetry symbols may not be possible. In this case, a telemetry spectrum may be estimated using statistical prior knowledge on the signal waveform.

After the process begins, in 702, a signal may be received from one or more downhole tools in a wellbore. The received signal may include a telemetry portion and noise portion. The received signal may include a telemetry portion and a noise portion. The received signal may be any type of signal, for example, an EM signal, a mud pulse signal, etc. The received signal may be transmitted from any type of tool within the wellbore. For example, the received signal may be transmitted by one or more MWD tools 154, one or more LWD tools 152, etc. The signal may be received by any type of receiver (e.g., sensors 160, 162). For example, the signal may be received by one or more EM sensors, one or more deep electrodes, etc. The signal may be detected by measuring a raw voltage across two electrodes.

In 704, an analytical telemetry spectrum may be generated. The analytical telemetry spectrum may be generated assuming that symbols are drawn from a uniform probability distribution. If the pulse shape is known and the symbols are drawn from a uniform probability distribution, the shape of a telemetry spectrum or theoretical telemetry spectrum may be produced analytically. For example, the telemetry spectrum may be produced using a Monte-Carlo simulation, closed-form solution, or other analytical solution.

In 706, an inverse problem may be solved to generate a spectrum estimate of the telemetry portion. In 708, the spectrum estimate of the telemetry portion may be subtracted from the spectrum of the received signal. In 710, the noise portion in the received signal may be estimated based at least partially on the subtraction of the spectrum estimate of the telemetry signal from the spectrum of the received signal.

For example, assuming that received signal, Pyy(f), may be approximated as $$Pyy(f)=k\cdot Pxx(f)+Pn_sn_s(f)+Pn_pn_p(f) \tag{10}$$

where Pxx(f) is the spectrum of the telemetry signal whose shape is produced analytically; $Pn_sn_s(f)$ is the spectrum of an unknown wideband smooth component; and $Pn_pn_p(f)$ is the spectrum of a component containing large peaks. The scaling coefficient k may be obtained by solving the following inverse problem:

$$\{k,Pn_sn_s(f),Pn_pn_p(f)\}=\text{argmin}(\|Pyy(f)-k\cdot Pxx(f)-Pn_sn_s(f)+Pn_pn_p(f)\|) \tag{11}$$

Then, the spectrum of the received noise can be obtained by subtracting the estimated telemetry signal from the observed spectrum:

$$Pnn(f)Pyy(f)-k\cdot Pxx(f) \tag{12}$$

In another embodiment, a noise cancellation method, such as a constant modulus, may be used to estimate Pxx(f). The noise spectrum may then be estimated as before using equation (12).

In 712, the telemetry mode and parameters may be configured based at least partially on the noise portion. A telemetry mode and parameters may be determined and implemented based on the spectrum estimates and noise. The telemetry mode and parameters may include one or more of a modulation type for transmitting the signal, a frequency band for transmitting the signal, a bit rate for transmitting the signal, a modulation rate for transmitting the signal, a carrier rate for transmitting the signal, a symbol rate for transmitting the signal, an amplitude for transmitting the signal, a pulse shape for transmitting the signal, a cyclic prefix length for transmitting the signal, a number of subcarriers for transmitting the signal, active subcarriers for transmitting the signal, a bandwidth for transmitting the signal, and the like. For example, the telemetry mode and parameters may include an optimal frequency bitrate pair, SNR/Watt ratio, highest bitrate, and/or highest SNR. In a dual telemetry situation, the telemetry mode and parameters may include an optimal transmission method, e.g., mud pulse or EM, and an optimal frequency and bitrate. In an EM multi-pad system, the telemetry mode and parameters may include frequency and bitrate options that maximize total throughput for the tools. Any of these may allow the downhole tool 140 to transmit with lower amplitude, which may save power.

The spectrum estimates may be used to determine a type of noise in the received signals. The type of noise may be used to determine, suggest, and implement one or more noise compensation methods. For example, the one or more noise compensation methods may include bit interleaving and ECC implemented in the transmitter, optimal block size to minimize latency, selecting an optimal carrier frequency and modulation type and bit rate, selecting subcarriers and assigning bit loading to those carriers in an OFDM signal, or frequency hopping for varying or unpredictable noise.

An estimation of the effectiveness of the telemetry mode and parameters may be provided. For example, the estimation may include a depth at which the telemetry mode and parameters would become undesirable, e.g., low SNR. The signal attenuation with depth may be based on an EM propagation model specific to a formation being drilled, a general model which assumes a homogenous formation, and the like. Once determined, the telemetry mode and parameters may be transmitted to the one or more downhole tools, for example, via the downlink telemetry signal.

In 714, in response to configuring the telemetry mode and/or parameters, a signal may be transmitted to the downhole tool 140 to cause the downhole tool 140 to perform a drilling action. The drilling actions are described above.

Figure 8:
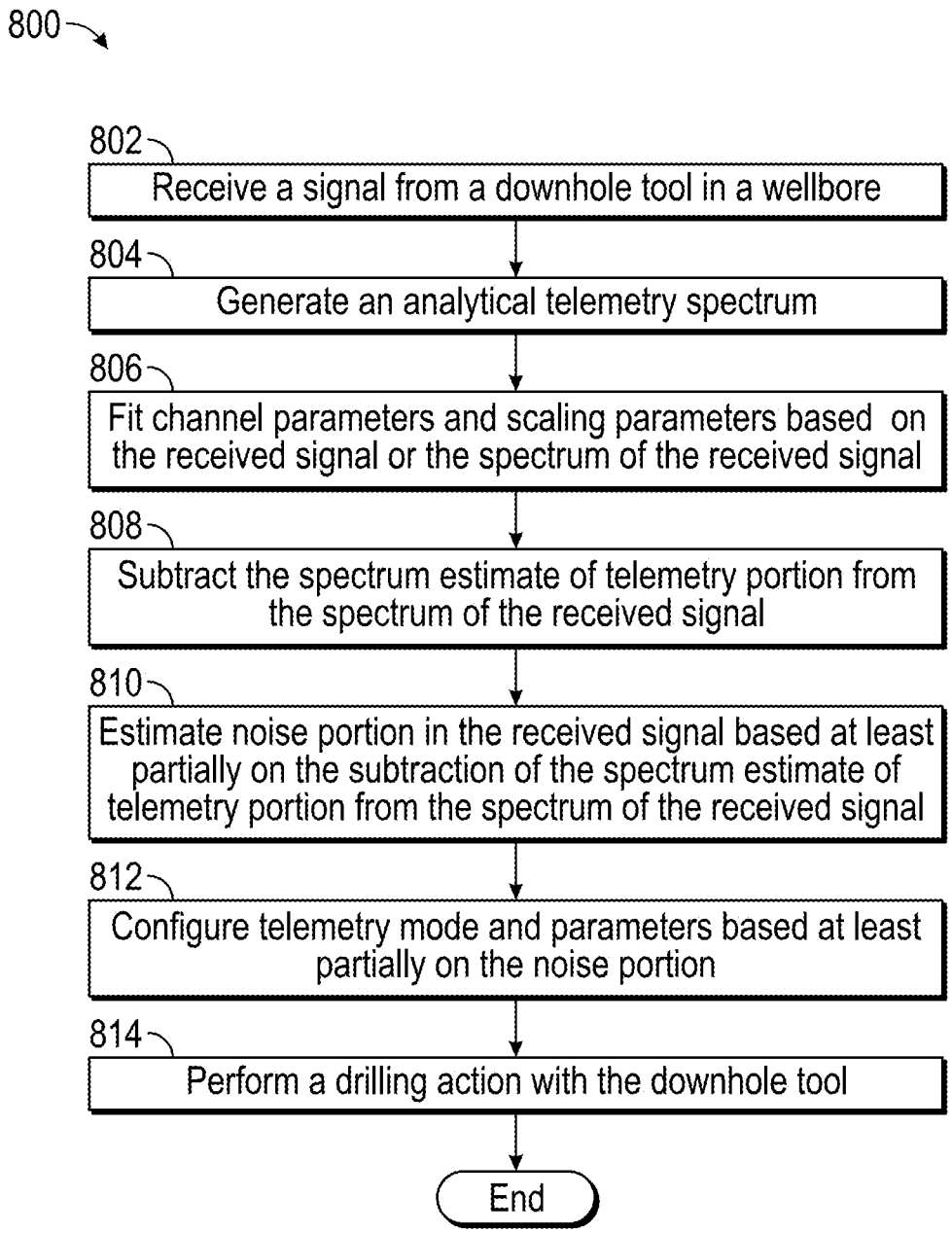
FIG. 8 illustrates a flowchart of another example of a method for estimating a spectrum of a telemetry signal sing an analytical telemetry spectrum and configuring transmission signals, according to an embodiment.

FIG. 8 illustrates another example of a method 800 using an analytical telemetry spectrum for estimating a spectrum of a telemetry signal and configuring transmission signals, according to an embodiment. For example, in a case of low SNR, demodulation of the telemetry symbols may not be possible. In this case, a telemetry spectrum may be estimated using statistical prior knowledge on the signal waveform.

After the process begins, in 802, a signal may be received from one or more downhole tools in a wellbore. The received signal may include a telemetry portion and a noise portion. The received signal may include a telemetry portion and a noise portion. The received signal may be any type of signal, for example, an EM signal, a mud pulse signal, etc. The received signal may be transmitted from any type of tool within the wellbore. For example, the received signal may be transmitted by one or more MWD tools 154, one or more LWD tools 152, etc. The signal may be received by any type of receiver (e.g., sensors 160, 162). For example, the signal may be received by one or more EM sensors, one or more deep electrodes, etc. The signal may be detected by measuring a raw voltage across two electrodes.

In 804, an analytical telemetry spectrum may be generated. The analytical telemetry spectrum may be generated assuming that symbols are drawn from a uniform probability distribution. Providing that the pulse shape may be known and the symbols are drawn from a uniform probability distribution, the shape of a telemetry spectrum or theoretical telemetry spectrum may be produced analytically. For example, the telemetry spectrum may be produced using a Monte-Carlo simulation, closed-form solution, or other analytical solution.

In 806, channel parameters and scaling parameters may be fit based on the observation or the spectrum of the received signal. In 808, the spectrum estimate of the telemetry portion, including the channel effects, may be subtracted from the spectrum of the received signal. In 810, the noise portion in the received signal may be estimated based at least partially on the subtraction of the spectrum estimate of the telemetry portion from the spectrum of the received signal.

For example, in the case of a propagation model $H(.|\theta)$ being available from prior knowledge or collected data about the formation, the inverse problem may be solved for the unknown parameters $\theta$ of the propagation model such that:

$$\{\theta, Pn_s n_s(f), Pn_p n_p(f)\} = \operatorname{argmin}(\|Pyy(f) - H(Pxx(f)|\theta) - Pn_s n_s(f) + Pn_p n_p(f)\|) \quad (13)$$

For example, one channel model may be $H(Pxx(f)|\theta) = \theta.Pxx(f)$, which is a scaling in the frequency domain. In another example, $H(Pxx(f)|\theta)$ can be an exponential scaling $H(Pxx(f)|\theta) = \exp(-\theta).Pxx(f)$, where $\theta$ is an unknown coefficient.

In 812, the telemetry mode and parameters may be configured based at least partially on the noise portion. A telemetry mode and parameters may be determined and implemented based on the spectrum estimates and noise. The telemetry mode and parameters may include one or more of a modulation type for transmitting the signal, a frequency band for transmitting the signal, a bit rate for transmitting the signal, a modulation rate for transmitting the signal, a carrier rate for transmitting the signal, a symbol rate for transmitting the signal, an amplitude for transmitting the signal, a pulse shape for transmitting the signal, a cyclic prefix length for transmitting the signal, a number of subcarriers for transmitting the signal, active subcarriers for transmitting the signal, a bandwidth for transmitting the signal, and the like. For example, the telemetry mode and parameters may include an optimal frequency bitrate pair, SNR/Watt ratio, highest bitrate, and/or highest SNR. In a dual telemetry situation, the telemetry mode and parameters may include an optimal transmission method, e.g., mud pulse or EM, and an optimal frequency and bitrate. In an EM multi-pad system, the telemetry mode and parameters may include frequency and bitrate options that maximize total throughput for the tools. Any of these may allow the downhole tool 140 to transmit with lower amplitude, which may save power.

The spectrum estimates may be used to determine a type of noise in the received signals. The type of noise may be used to determine, suggest, and implement one or more noise compensation methods. For example, the one or more noise compensation methods may include bit interleaving and ECC implemented in the transmitter, optimal block size to minimize latency, selecting an optimal carrier frequency and modulation type and bit rate, selecting subcarriers and assigning bit loading to those carriers in an OFDM signal, or frequency hopping for varying or unpredictable noise.

An estimation of the effectiveness of the telemetry mode and parameters may be provided. For example, the estimation may include a depth at which the telemetry mode and parameters would become undesirable, e.g., low SNR. The signal attenuation with depth may be based on an EM propagation model specific to a formation being drilled, a general model which assumes a homogenous formation, and the like. Once determined, the telemetry mode and parameters may be transmitted to the one or more downhole tools, for example, via the downlink telemetry signal.

In 814, in response to configuring the telemetry mode and/or parameters, a signal may be transmitted to the downhole tool 140 to cause the downhole tool 140 to perform a drilling action. The drilling actions are described above.

Figure 9A:
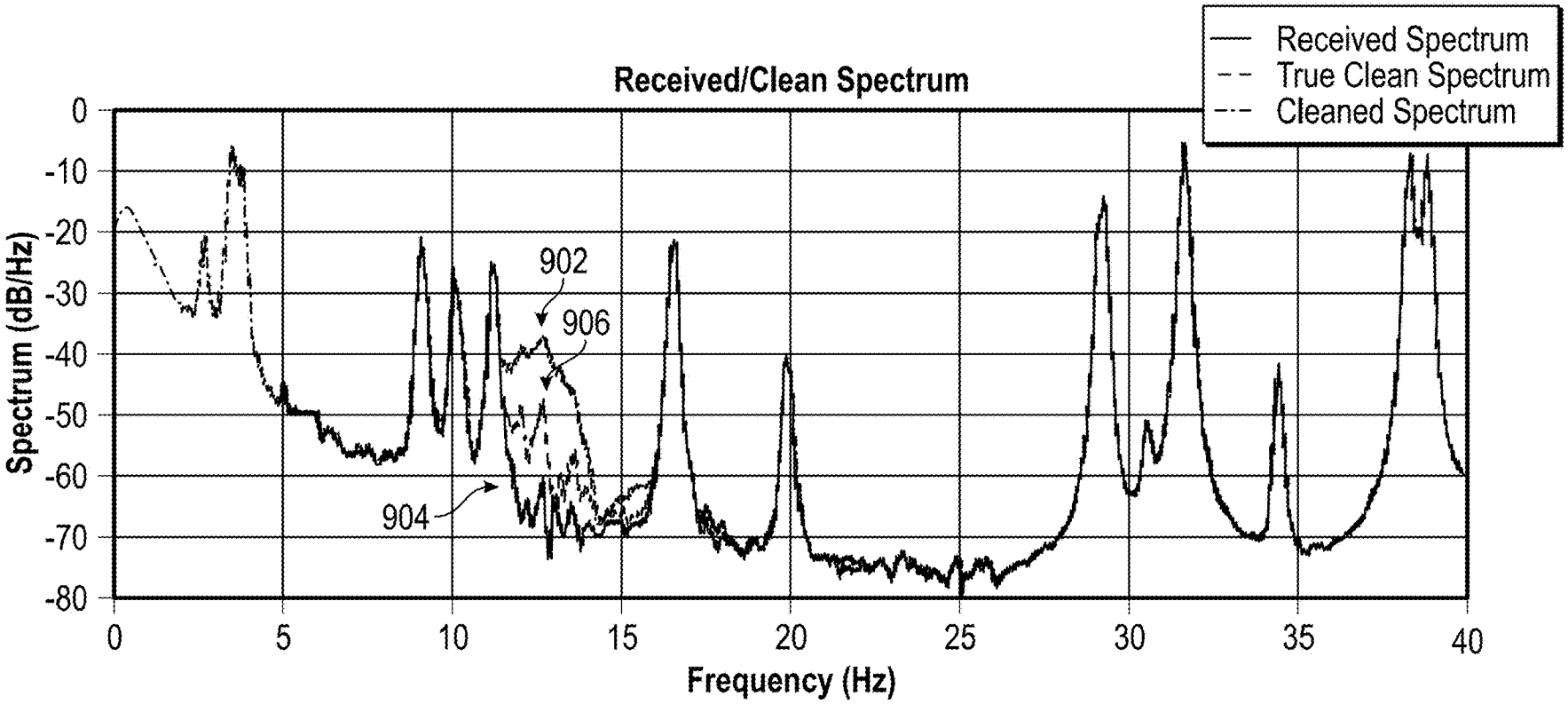
FIGS. 9A-9D illustrate diagrams of example results from the method of FIG. 7 and the method of FIG. 8, according to an embodiment.
Figure 9B:
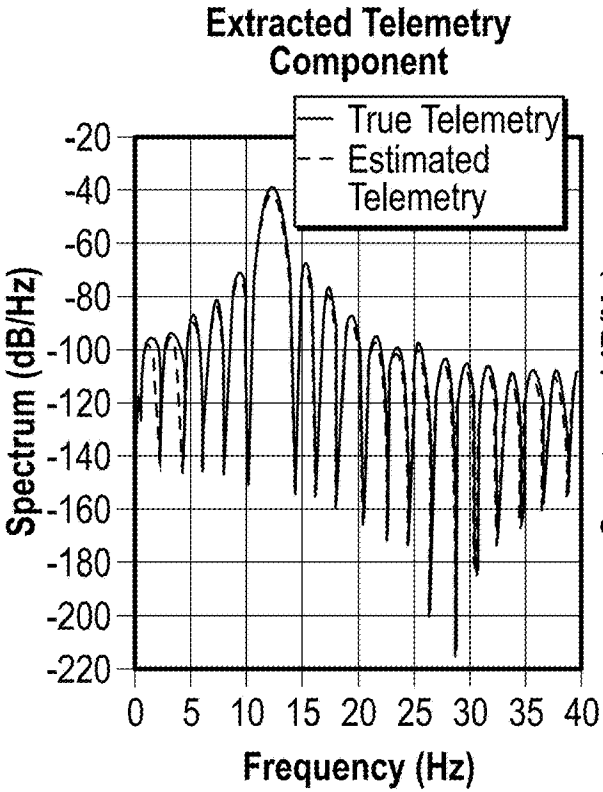
Figure 9C:
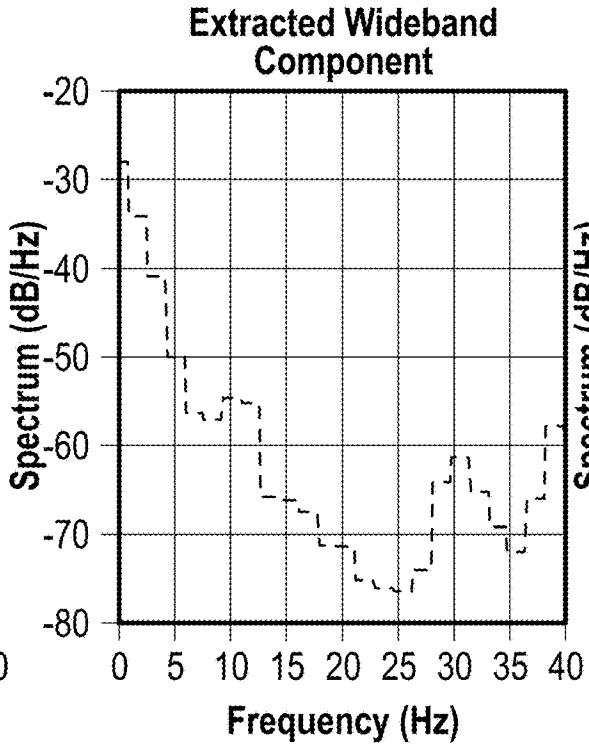
Figure 9D:
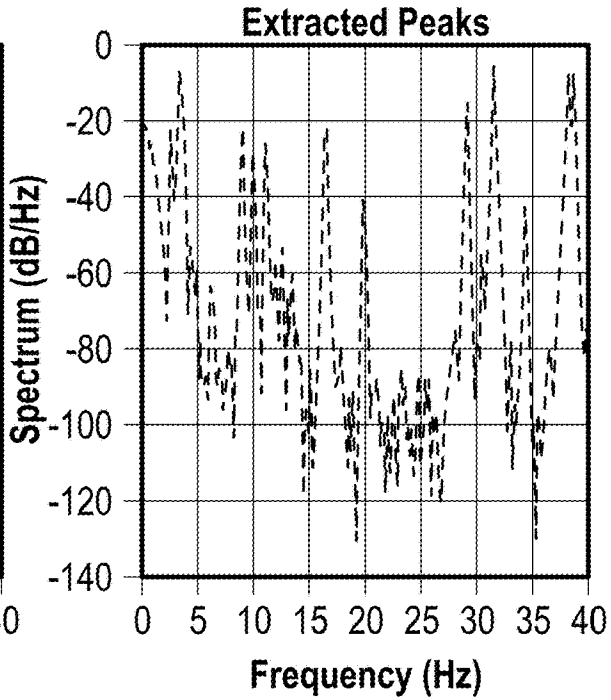

FIGS. 9A-9D illustrate examples of the results of the method 700 and the method 800. In FIG. 9A, the plot 902 represents the received spectrum, the plot 904 represent the true spectrum of the noise, and the plot 906 represent the estimated spectrum of the noise. FIG. 9B illustrates the estimated spectrum for the received signal. FIG. 9C illustrates the estimated spectrum of wideband channel for the received signal. FIG. 9D illustrates the estimated spectrum of peaks components for the received signal.

In any of the methods 300, 500, 700, and 800 (or methods described below), the processes for configuring transmission signals may be performed for a downhole tool that includes a narrow-band transmitter. For example, when pulse shaping is used at the transmitter to limit and control the distribution of signal power outside of the main telemetry band, e.g., square root of raised cosine pulse shaping, Gaussian minimum shift keying, and the like, the information about the transmitted signal's spectrum may be used to improve the estimation of the signal and noise spectra. For instance, the spectrum of the telemetry portion may be simulated utilizing the data symbols or packets determined for the received signal and the telemetry and mode parameters used to send the received signal by the narrow-band transmitter, e.g., modulation type, carrier signal, pulse shaping, etc. Additionally, for example, the attenuation of the received signal may be simulated utilizing propagation channel that has been estimated. For instance, any of the equations (1) through (9) may be utilized in the simulations.

The MWD signals may be affected by different types of noise. For example, the following types of noise may affect the MWD signals:

stationary, steady periodic noise such as the noise from 60 Hz power line;

periodic noise dependent on drilling rig activity around 30 Hz and 15-18 Hz; which may change depending on activity;

broadband noise that fluctuates; and impulsive noise due to banging, or other events.

Noise levels may be highly dependent on the frequency of interest and thus the impact on the SNR may be highly dependent on the frequency and bandwidth used for MWD signals. Some noise comes and goes. On the other hand, uplink signal attenuation—thus, the corresponding received signal level—may be highly dependent on formation characteristics and the frequency chosen for the MWD tool. In an embodiment, a modulation setting may be selected that matches the noise conditions of the well site. To choose modulation setting, a combination of the noise measurement on the surface and an estimate of received signal level at different frequencies may be utilized to estimate what the SNR would be for different uplink modulation settings. The settings are then transmitted to one or more downhole tools.

Figure 10:
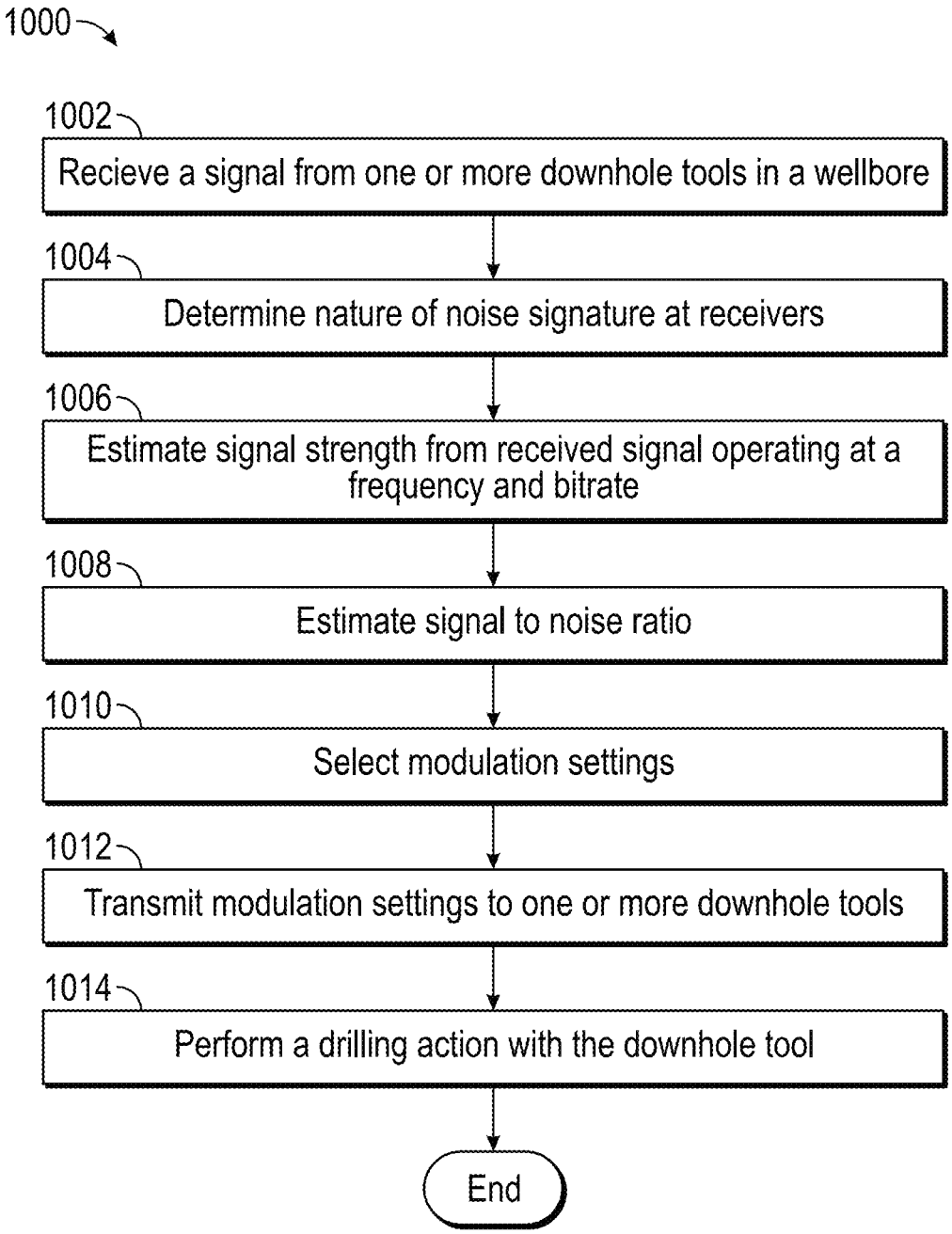
FIG. 10 illustrates a flowchart of another example of a method for selecting and configuring modulation settings for different noise conditions, according to an embodiment.

FIG. 10 illustrates another example of a method 1000 for selecting and configuring modulation settings for different noise conditions, according to an embodiment. After the process begins, in 802, a signal may be received from one or more downhole tools in a wellbore. The received signal may include a telemetry portion and noise portion. The received signal may include a telemetry portion and a noise portion. The received signal may be any type of signal, for example, an EM signal, a mud pulse signal, etc. The received signal may be transmitted from any type of tool within the wellbore. For example, the received signal may be transmitted by one or more MWD tools 154, one or more LWD tools 152, etc. The signal may be received by any type of receiver (e.g., sensors 160, 162). For example, the signal may be received by one or more EM sensors, one or more deep electrodes, etc. The signal may be detected by measuring a raw voltage across two electrodes.

In 1004, a nature of a noise signature at the receivers may be determined. In an embodiment, various analysis may be performed on the received signal to determine the nature of the noise signature.

For example, a time analysis may be performed on the received signals. The time analysis may provide information about the appearance of the noise in time. The time analysis may be performed to determine one or more of energy at various times, peak to peak noise signals at various times, median noise signal, sliding average of the noise signals, peak noise signal, and the like.

For example, a spectral analysis may be performed on the received signals. The spectral analysis may provide information about the distribution of the noise in frequency. The spectral analysis may be performed using one or more of a Fast Fourier Transform, Welch's average, parametric spectral analysis, and the like.

For example, time-frequency analysis may be performed. The time-frequency analysis may provide information about the evolution of the noise's frequency content over time. The time-frequency analysis may be performed by using one or more of a short-time Fourier transform, Wigner-Ville transform, Wavelets transform, and the like.

For example, statistical analysis may be performed. The statistical analysis may provide statistical information about the noise. Statistical analysis may be done either on the raw received signal or in the passband of the signal of interest. The statistical analysis may include Bayesian estimation, Percentile ranking, and the like.

Figure 11:
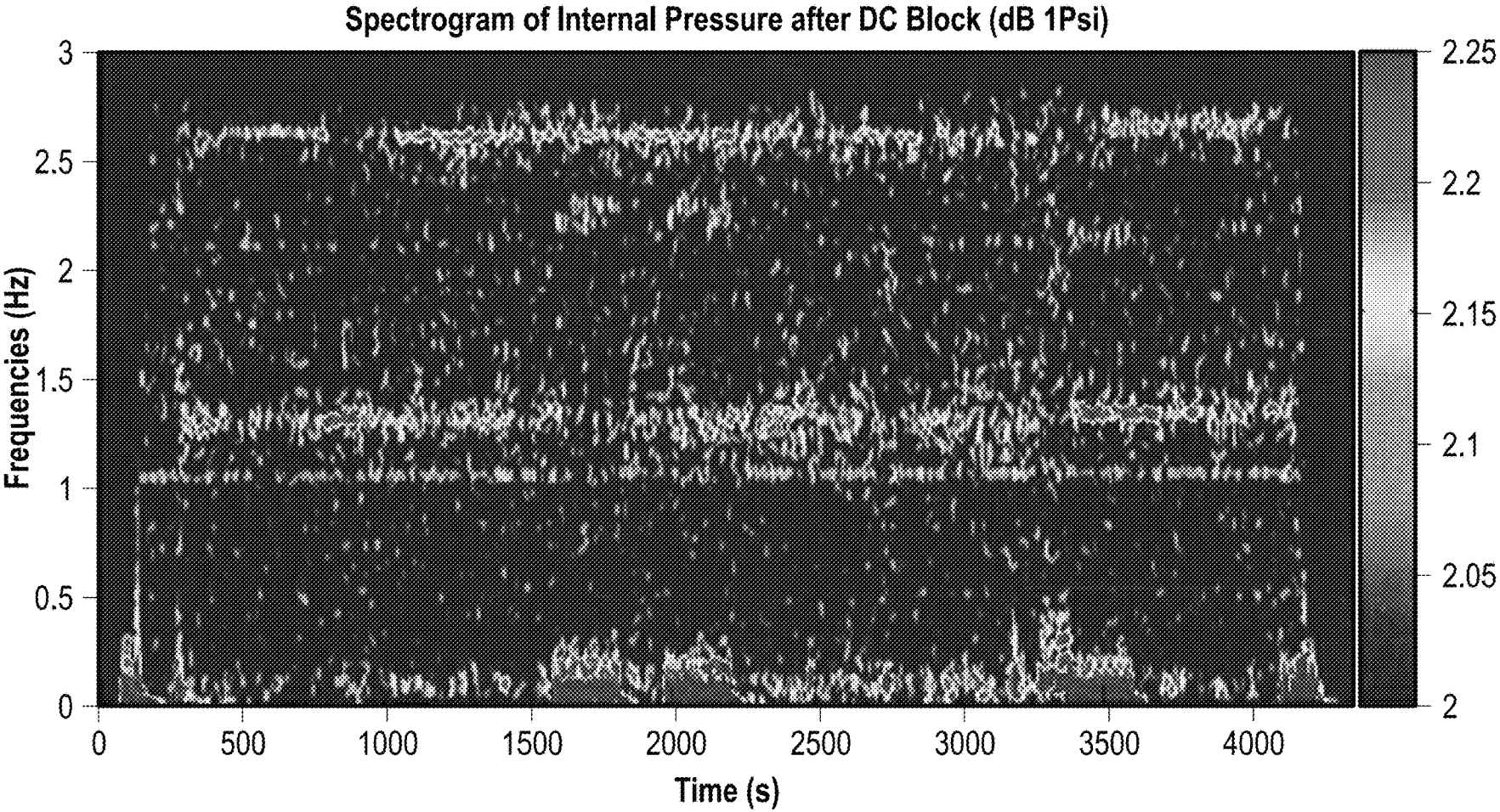
FIG. 11 illustrates a diagram of an example of varying noise or periodically-changing noise, according to an embodiment.

Time domain analysis and time-frequency analysis may be able to identify and analyze time-varying noise or periodically-changing noise. FIG. 11 illustrates an example of varying noise or periodically-changing noise. As illustrated, at very low frequencies, noise may appear and disappear over time. With a time-domain and/or time-frequency analysis, this noise may be determined and considered with the noise characteristics when the noise is ongoing versus when the noise is not ongoing, as opposed to simplistic descriptions such as root mean square (RMS) noise within a long time window.

Referring back to FIG. 10, in 1006, the signal strength may be estimated from the received signal operating at a frequency and bitrate. For example, the signal strength may be directly estimated from the received signal operating at frequency f0 and bitrate b0. For example, a model of signal strength may be determined for the received signal operating at frequency f0 and bitrate b0. Based on the determined model, frequency strength, S(f), for other frequency values, f, may be estimated by based on S(f0). If a model is not available, then S(f)=S(f0) may be assumed for the respective frequencies, f.

For example, if model is available, and expected formation resistivity values of the formation are known, the future signal strength values may be predicted, and the model may be calibrated based on received signal strength, as models often vary by a certain fixed constant.

Figure 12:
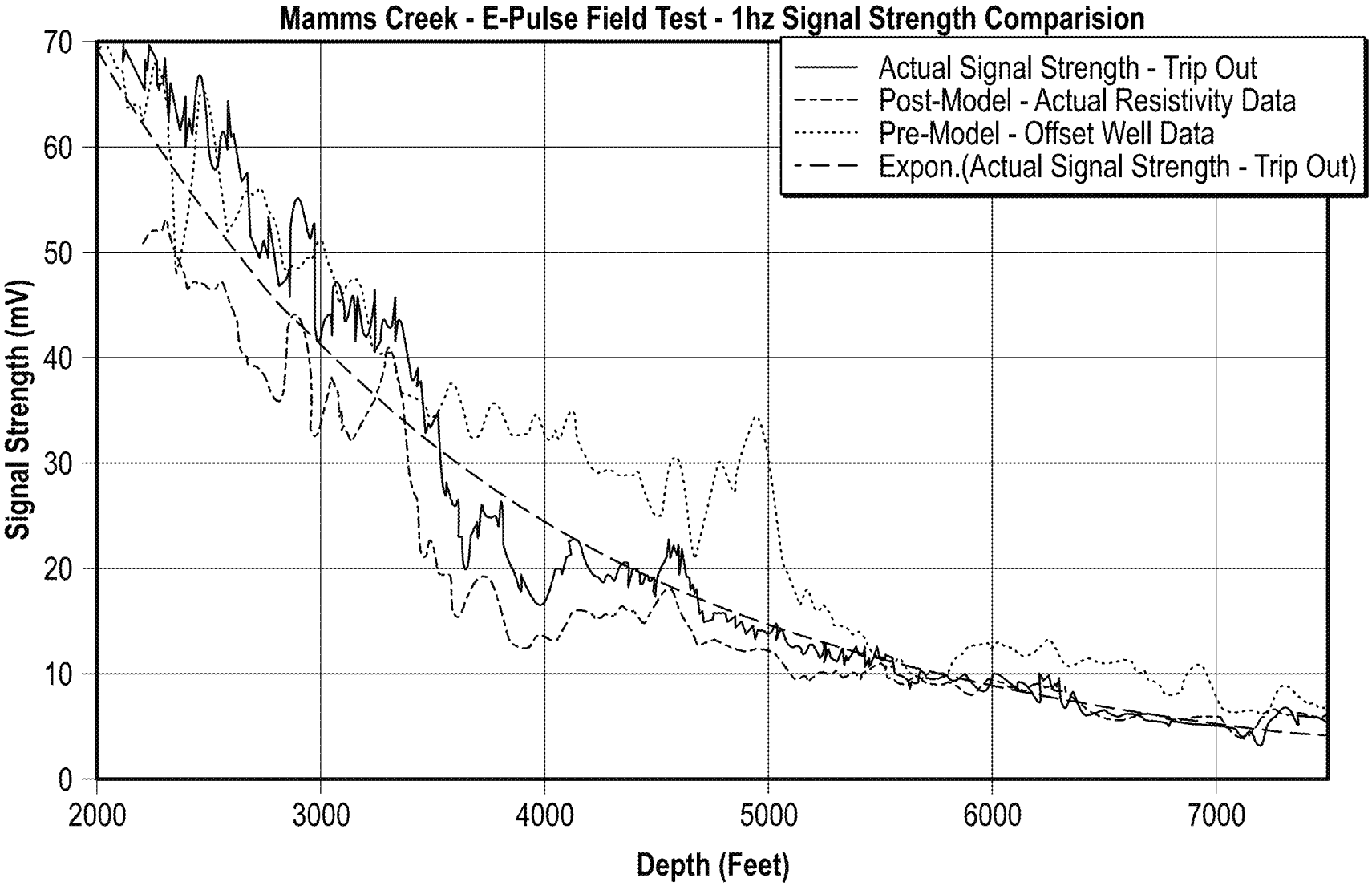
FIG. 12 illustrates a diagram of an example for using a simplified Maxwell's equation for homogeneous formation and low frequency, according to an embodiment.

For example, one model that may be utilized is a simplified Maxwell's equation for homogeneous formation and low frequency:

$$i = Ie^{-\left(kd\sqrt{f}\sqrt{\frac{1}{R}}\right)} \tag{12}$$

where I is the current returning to the gap at d, d is the depth or distance above gap, f is the frequency, R is mean formation resistivity, I is injected current, and k is a proportionality constant. By calibrating the model using the received signals strength, the scaling with frequency can be extrapolated for a downhole tool at a given position. Also, signal decay may be extrapolated as drilling continues. FIG. 12 illustrates a fit using a simplified Maxwell's equation for homogeneous formation and low frequency.

Referring back to FIG. 10, in 1008, a SNR may be estimated. For example, a list containing different modulation candidates may be maintained. Each modulation candidate of the list may be characterized by its modulation scheme (e.g., PSK modulations, FSK, QAM, and the like). Each modulation candidate of the list may be including different and/or multiple carrier frequencies and its bitrates. This list may represent possible modulations that may be used by a transmitter of the one or more downhole tools to generate the uplink signal.

For each modulation candidate of the list, the effective SNR may be computed. For example, for each modulation candidate, a signal strength may be estimated either directly or from a model. Then, for each modulation candidate, the effective noise strength within the bandwidth of that modulation may be computed. For this, an effective SNR may be computed for each modulation candidate.

Also, a synthetic telemetry signal with signal parameters from the determination of the signal strength signal may be estimated. Then, a synthetic noise consistent with noise parameters from the noise characteristics determination may be estimated. The SNR may be estimated from the probability distribution function of the constellation with a Bayesian inference algorithm, and the SNR estimated at this stage may be associated with each modulation candidate of the list. Further, the estimate of future signal strength for each of the modulation choice as described above may be used in model-based signal strength estimation and prediction.

For example, suppose that for each frequency bin f, a histogram of noise based on a window of observation is computed. Then, for each frequency f, statistical characteristics such as the RMS noise, or 90th percentile of noise, or median noise may be determined. Then, for each of these, the corresponding SNR value may be computed, such that the mean SNR, or 90th percentile SNR, or median SNR are obtained. From these intermediate quantities, the optimal modulation settings can be selected. By doing this, performance margins may be introduced into our modulation choice.

In 1010, modulation settings may be selected. For example, the modulation settings with the highest SNR value, when compared to other modulation settings, may be selected.

In 1012, the modulation settings may be transmitted to one or more downhole tools. For example, an opcode associated with the modulation setting may be transmitted to one or more downhole tools.

In 1014, in response to configuring the telemetry mode and/or parameters, a signal may be transmitted to the downhole tool 140 to cause the downhole tool 140 to perform a drilling action. The drilling actions are described above.

Figure 13:
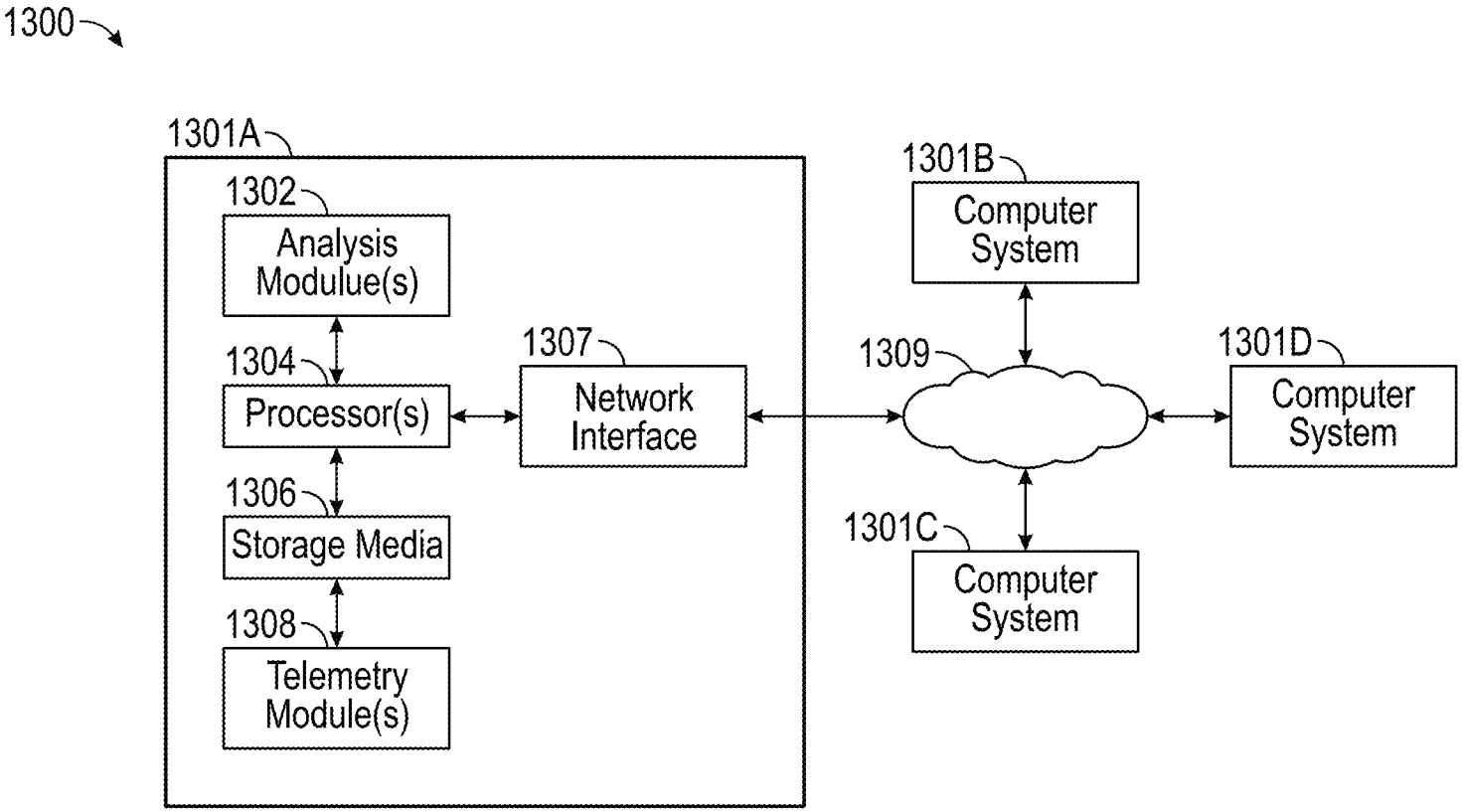
FIG. 13 illustrates a schematic view of a computing system, according to an embodiment.

In some embodiments, the methods of the present disclosure may be executed by a computing system. FIG. 13 illustrates an example of such a computing system 1300, in accordance with some embodiments. The computing system 1300 may include a computer or computer system 1301A, which may be an individual computer system 1301A or an arrangement of distributed computer systems. The computer system 1301A includes one or more signal analysis modules 1302 that are configured to perform various tasks according to some embodiments, such as one or more methods disclosed herein. To perform these various tasks, the analysis module 1302 executes independently, or in coordination with, one or more processors 1304, which is (or are) connected to one or more storage media 1306. The processor (s) 1304 is (or are) also connected to a network interface 1307 to allow the computer system 1301A to communicate over a data network 1309 with one or more additional computer systems and/or computing systems, such as 1301B, 1301C, and/or 1301D (note that computer systems 1301B, 1301C and/or 1301D may or may not share the same architecture as computer system 1301A, and may be located in different physical locations, e.g., computer systems 1301A and 1301B may be located in a processing facility, while in communication with one or more computer systems such as 1301C and/or 1301D that are located in one or more data centers, and/or located in varying countries on different continents).

A processor may include a microprocessor, microcontroller, processor module or subsystem, programmable integrated circuit, programmable gate array, or another control or computing device.

The storage media 1306 may be implemented as one or more computer-readable or machine-readable storage media. Note that while in the example embodiment of FIG. 13 storage media 1306 is depicted as within computer system 1301A, in some embodiments, storage media 1306 may be distributed within and/or across multiple internal and/or external enclosures of computing system 1301A and/or additional computing systems. Storage media 1306 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLUERAY® disks, or other types of optical storage, or other types of storage devices. Note that the instructions discussed above may be provided on one computer-readable or machine-readable storage medium, or may be provided on multiple computer-readable or machine-readable storage media distributed in a large system having possibly plural nodes. Such computer-readable or machine-readable storage medium or media is (are) considered to be part of an article (or article of manufacture). An article or article of manufacture may refer to any manufactured single component or multiple components. The storage medium or media may be located either in the machine running the machine-readable instructions, or located at a remote site from which machine-readable instructions may be downloaded over a network for execution.

In some embodiments, the computing system 1300 contains one or more telemetry module(s) 1308. The telemetry module(s) 1308 may be used to perform at least a portion of one or more embodiments of the methods disclosed herein (e.g., methods 300, 500, 700, 800, 1000).

It should be appreciated that computing system 1300 is an one example of a computing system, and that computing system 1300 may have more or fewer components than shown, may combine additional components not depicted in the example embodiment of FIG. 13, and/or computing system 1300 may have a different configuration or arrangement of the components depicted in FIG. 13. The various components shown in FIG. 13 may be implemented in hardware, software, or a combination of both hardware and software, including one or more signal processing and/or application specific integrated circuits.

Further, the methods described herein may be implemented by running one or more functional modules in information processing apparatus such as general purpose processors or application specific chips, such as ASICs, FPGAs, PLDs, or other appropriate devices. These modules, combinations of these modules, and/or their combination with general hardware are all included within the scope of protection of the disclosure.

The foregoing description, for purpose of explanation, has been described with reference to specific embodiments. However, the illustrative discussions above are not intended to be exhaustive or to limit the disclosure to the precise forms disclosed. Many modifications and variations are possible in view of the above teachings. Moreover, the order in which the elements of the methods described herein are illustrate and described may be re-arranged, and/or two or more elements may occur simultaneously. The embodiments were chosen and described in order to best explain the principals of the disclosure and its practical applications, to thereby enable others skilled in the art to best utilize the disclosure and various embodiments with various modifications as are suited to the particular use contemplated. Additional information supporting the disclosure is contained in the appendix attached hereto.

What is claimed is:

1. A method for configuring transmission signals in a measuring while drilling (MWD) wellbore tool, comprising:

receiving at an earth surface, from a transmission of the MWD wellbore tool, a signal from the MWD wellbore tool in a wellbore, wherein the signal comprises a noise portion and a telemetry portion, the telemetry portion comprising physical properties of the wellbore measured in the wellbore;

generating an analytical telemetry spectrum, wherein the analytical telemetry spectrum represents an ideal spectrum of the telemetry portion;

generating a spectrum estimate of the telemetry portion based at least partially on the analytical telemetry spectrum;

subtracting the spectrum estimate of the telemetry portion from a spectrum of the signal;

estimating, based at least partially on the subtraction, the noise portion of the signal; and altering a transmission configuration of the MWD wellbore tool, for further transmitting the signal to the earth surface, based at least partially on the estimated noise portion of the signal.

2. The method of claim 1, wherein altering the transmission configuration comprises at least one of setting a modulation type for transmitting the signal, setting a frequency band for transmitting the signal, setting a bit rate for transmitting the signal, setting a modulation rate for transmitting the signal, setting a carrier rate for transmitting the signal, setting a symbol rate for transmitting the signal, setting an amplitude for transmitting the signal, setting a pulse shape for transmitting the signal, setting a cyclic prefix length for transmitting the signal, setting a number of subcarriers for transmitting the signal, setting active subcarriers for transmitting the signal, setting a bandwidth for transmitting the signal, setting a noise reduction method for the signal, and setting a maximum depth for transmitting the signal.

3. The method of claim 1, wherein altering the transmission configuration comprises sending one or more telemetry modes or parameters to the MWD wellbore tool.

4. The method of claim 1, wherein the signal comprises at least one of a mud pulse signal or an electromagnetic signal.

5. The method of claim 1, where generating the spectrum estimate of the telemetry portion comprises solving an inverse problem for the analytical telemetry spectrum.

6. The method of claim 1, where generating the spectrum estimate of the telemetry portion comprises fitting channel parameters and scaling parameters based at least partially on the analytical telemetry spectrum.

* * * * *